US008251235B2

(12) United States Patent
Py et al.

(10) Patent No.: US 8,251,235 B2
(45) Date of Patent: Aug. 28, 2012

(54) LIQUID NUTRITION PRODUCT DISPENSER WITH PLURAL PRODUCT CHAMBERS FOR SEPARATE STORAGE AND INTERMIXING PRIOR TO USE, AND RELATED METHOD

(75) Inventors: Daniel Py, Larchmont, NY (US); Julian Chan, New Milford, CT (US); Jeffrey Willey, Brookfield, CT (US)

(73) Assignee: Medical Instill Technologies, Inc., New Milford, CT (US)

( * ) Notice: Subject to any disclaimer, the term of this patent is extended or adjusted under 35 U.S.C. 154(b) by 551 days.

(21) Appl. No.: 12/259,284

(22) Filed: Oct. 27, 2008

(65) Prior Publication Data

US 2009/0139883 A1 Jun. 4, 2009

Related U.S. Application Data

(60) Provisional application No. 60/983,153, filed on Oct. 26, 2007.

(51) Int. Cl.
*A61J 9/00* (2006.01)

(52) U.S. Cl. ..... 215/11.4; 215/11.6; 220/502; 220/521; 206/217

(58) Field of Classification Search ..... 220/500, 220/501, 502, 503, 526, 521, 507, 525; 215/11.4, 215/227, 11.1, 11.5, 11.6; 206/222, 219, 206/220, 217

See application file for complete search history.

(56) References Cited

U.S. PATENT DOCUMENTS 2,619,088 A * 11/1952 Saffir ..... 604/407
3,200,860 A 8/1965 Barton et al.
3,334,764 A 8/1967 Fouser
3,424,329 A 1/1969 Hershberg et al.
3,532,242 A 10/1970 Tibbs
3,586,196 A 6/1971 Barton et al.
3,645,262 A 2/1972 Harrigan (Continued)

FOREIGN PATENT DOCUMENTS

GB 2 164 325 A 3/1986

(Continued)

OTHER PUBLICATIONS

International Search Report and Written Opinion of the International Searching Authority for International Application No. PCT/US2008/81395.

*Primary Examiner* — Mickey Yu
*Assistant Examiner* — Kareen Rush
(74) *Attorney, Agent, or Firm* — McCarter & English, LLP

(57) ABSTRACT

A container including a body defining an outflow opening and at least one chamber adapted for storing a product, such as a fat containing liquid product, and a container closure including a primary seal for hermetically sealing the product within the chamber during storage. The container closure includes a sealing member forming a substantially fluid-tight seal between the container closure and the body, and a dispensing member in fluid communication with the chamber. The container closure and body move relative to each other between a first position where the primary seal is seated about the outflow port to hermetically seal the product in the chamber during storage, and a second position where the primary seal is displaced from the outflow port to allow product to pass from the chamber through the outflow port and into dispensing member to dispense the product.

29 Claims, 18 Drawing Sheets

U.S. PATENT DOCUMENTS

| | | | | |
|---|---|---|---|---|
| 3,747,791 | A | 7/1973 | Fouser | |
| 4,620,638 | A | 11/1986 | Schmidt | |
| 4,676,387 | A | 6/1987 | Stephenson et al. | |
| 4,821,895 | A | 4/1989 | Roskilly | |
| 4,834,099 | A | 5/1989 | Schrooten | |
| 4,867,325 | A | 9/1989 | Dransfield | |
| 5,101,991 | A | 4/1992 | Morifuji et al. | |
| 5,190,174 | A | 3/1993 | Klag | |
| 5,275,298 | A | 1/1994 | Holley et al. | |
| 5,419,445 | A | 5/1995 | Kaesemeyer | |
| 5,433,328 | A | 7/1995 | Baron et al. | |
| 5,747,083 | A * | 5/1998 | Raymond et al. | 426/117 |
| 5,950,689 | A * | 9/1999 | Varlet | 141/22 |
| 6,098,795 | A * | 8/2000 | Mollstam et al. | 206/222 |
| 6,257,428 | B1 * | 7/2001 | Caola | 215/11.1 |
| 6,481,571 | B1 | 11/2002 | Kelders et al. | |
| 6,499,615 | B1 | 12/2002 | Szieff et al. | |
| 6,616,319 | B2 | 9/2003 | Renz | |
| 6,920,991 | B2 | 7/2005 | Holley, Jr. | |
| 6,971,551 | B2 | 12/2005 | Widgery | |
| 7,780,023 | B2 | 8/2010 | Py et al. | |
| 2002/0035997 | A1 | 3/2002 | Shapira | |
| 2003/0071006 | A1 | 4/2003 | Kolb | |
| 2004/0124168 | A1 | 7/2004 | Silver | |
| 2005/0194341 | A1 | 9/2005 | Houraney | |
| 2006/0137998 | A1 | 6/2006 | Spector et al. | |
| 2007/0283666 | A1 * | 12/2007 | Py et al. | 53/425 |
| 2008/0054001 | A1 | 3/2008 | Roth et al. | |

FOREIGN PATENT DOCUMENTS

| | | | |
|---|---|---|---|
| WO | WO 03/101858 | A2 | 12/2003 |
| WO | WO 2007/120719 | A2 | 10/2007 |

* cited by examiner

LIQUID NUTRITION PRODUCT DISPENSER WITH PLURAL PRODUCT CHAMBERS FOR SEPARATE STORAGE AND INTERMIXING PRIOR TO USE, AND RELATED METHOD

CROSS REFERENCE TO PRIORITY AND RELATED APPLICATIONS

This patent application claims priority on U.S. Provisional Patent Application Ser. No. 60/983,153, filed Oct. 26, 2007, entitled "Ready to Feed Container with Drinking Dispenser and Sealing Member, and Related Method", which is hereby incorporated by reference in its entirety as part of the present disclosure. This patent application also discloses and claims subject matter similar to that disclosed and claimed in co-pending patent application Ser. No. 12/259,279 entitled "Ready to Feed Container with Drinking Dispenser and Sealing Member, and Related Method", filed on even date herewith, and associated with; co-pending patent application Ser. No. 12/259,290 entitled "Dispenser with Plural Product Chambers for Separate Storage and Intermixing of Products Prior to Use, and Related Method", filed on even date herewith.

FIELD OF THE INVENTION

The present invention relates to a dispensers including plural chambers for storing separate products, and more particularly, to such dispensers that store aseptically filled liquid nutrition products and allow intermixing of such products prior to use, and to related methods.

BACKGROUND INFORMATION

Drinking containers are used to store and dispense a variety of products. The containers are sterilized, filled, hermetically sealed, and then stored for consumer use. To seal the product within the container, thermoplastic elastomer ("TPE") seals are most often employed. One of the drawbacks of such TPE seals is that they can be difficult to use with fat containing liquid products, such as infant or baby formulas, or other milk-based or low acid products. For example, many such TPE materials contain leachables that can leach into the fat containing product, or otherwise can undesirably alter a taste profile of the product.

Another disadvantage of prior art drinking containers is that the TPE seals cover an undesirably large portion of the inner surface area where the product is stored, which increases the product's exposure to TPEs and further contributes to the difficulty in storing fat containing liquid products, such as infant or baby formulas, or other milk-based or low acid products.

A further drawback of prior art drinking containers, particularly containers for storing fat containing liquid products, such as infant or baby formulas, or other milk-based or low acid products, is that in order to drink or otherwise dispense the product, the screw cap or other type of closure must first be removed from the open mouth of the container. Then, the product is poured into a different container, such as a baby bottle having a nipple, or a container closure having a nipple is screwed onto the open mouth of the container. These procedures not only can be inconvenient and time consuming, but can lead to spillage and/or contamination of the product.

Another drawback of prior art drinking containers and methods of filling such containers is that the containers may not provide the desired level of safety with respect to asepsis.

Another drawback of prior art drinking containers is that they do not offer the desired level of convenience with respect to the preparation and feeding, or provide a relatively simple intuitive functionality.

Another drawback of prior art drinking containers is that the containers may not provide the desired level of comfort to a feeding infant in comparison to natural breast feeding and can contribute to incidents of otitis, i.e. ear infections caused by fluid build-up in the middle ear attributed in some cases to negative pressures generated by the infant during bottle feeding and/or colic. Yet another drawback is such containers can, during tooth development, contribute to orthodontic conditions such as tooth misalignments.

Another drawback of prior art drinking containers is that after the containers are filled and sterilized, the containers must be sealed and capped in separate stages, effectively reducing manufacturing throughput and increasing manufacturing costs.

Yet another drawback of prior art drinking containers is that is that once the containers are filled with product, the filled containers must undergo aseptic processing, such as retort sterilization, where heat is applied to the product, which in turn, can negatively affect the product formulation.

Another drawback of some prior art dispensers, such as dispensers for storing and dispensing liquid nutrition products, is that they do not allow for separate products, or components or ingredients of products, such as infant formulas and dietary and nutritional supplements, to be stored in the dispensers in separate chambers and intermixed shortly prior to use. As a result, such dispensers either do not allow for products containing certain desired combinations of ingredients, or provide products of lower quality than otherwise desired when products with certain combinations of ingredients are stored therein.

Accordingly, it is an object of the present invention to overcome one or more of the above-described drawbacks and/or disadvantages of the prior art.

SUMMARY OF THE INVENTION

In accordance with a first aspect, the present invention is directed to a dispenser comprising a first body portion defining a first hermetically sealed chamber aseptically filled with a first liquid nutrition product, and a second body portion defining a second hermetically sealed chamber. The second body portion includes a second chamber filling portion that is in fluid communication with the second hermetically sealed chamber, and is configured to receive a filling member to aseptically fill the second hermetically sealed chamber with a second product therethrough, and is resealable to hermetically seal the second product within the second chamber. The second chamber is aseptically filled with a second product, and the first and second chambers define (i) a storage state in which the first and second chambers are hermetically sealed relative to each other and the first and second products are prevented from intermixing, and (ii) a dispensing state in which the first and second chambers are in fluid communication with each other to allow intermixing and dispensing of the intermixed first and second products. A dispensing device is in fluid communication with the first and/or second chambers in the dispensing state for dispensing the intermixed first and second products therethrough.

Some embodiments of the present invention further comprise a first chamber filling portion that is in fluid communication with the first hermetically sealed chamber. The first chamber filling portion is configured to receive a filling member to aseptically fill the first hermetically sealed chamber with the first product therethrough, and is resealable to hermetically seal the first product within the first chamber.

In some embodiments of the present invention the first product is a liquid nutrition product, and the second product is an additive. In some such embodiments, the liquid nutrition product is an infant formula, and the additive is a probiotic. In some embodiments of the present invention, the first liquid nutrition product is a base liquid product, and the second product is an additive to the first liquid nutrition product. In some such embodiments, the first liquid nutrition product is selected from the group consisting of a milk product, a soy product, a fat-containing product, a low acid product, and any combination of the foregoing, and the second product is selected from the group consisting of a probiotic supplement, vitamin supplement, mineral supplement, dietary supplement, flavoring, and a medicament.

In some embodiments of the present invention, the first and/or second body portions are movable relative to the other from the storage state to the dispensing state. In some embodiments of the present invention, the dispenser further comprises a sealing ring. The sealing ring is adapted to engage with the first chamber so as to provide an enclosed mixing space defining the second chamber that is bounded by a wall of the first chamber, a wall of the dispensing device, and the sealing ring. The mixing space contains a second product in the form of an additive for the liquid nutrition product, and is operable to open the chamber and permit the liquid nutrition product to mix with the additive in the mixing space and be dispensed to the exterior through the dispensing device. The second chamber filling portion is located on a wall of the dispensing device and is penetrable by an injection member to form an aperture through which the additive is introduced into the mixing space.

In some embodiments of the present invention, the dispensing device defines a teat (or nipple). In other embodiments, the dispensing device defines at least one of (i) a drinking spout; (ii) a drinking spout including a one-way check valve, wherein the check valve opens under negative pressure to allow the intermixed product to be dispensed therethrough; and (iii) a push-pull cap, wherein the push-pull cap defines an outlet aperture that is closed when the cap is in a retracted push position and the outlet aperture is open when the cap is in an extended pull position.

In accordance with another aspect, the present invention is directed to a dispenser including a generally cylindrical sealed chamber containing a liquid nutrition product, a dispensing device, and a sealing ring. The sealing ring is adapted to engage with the chamber so as to provide an enclosed mixing space bounded by an end wall of the chamber, a wall of the dispensing device and the sealing ring. The mixing space contains an additive for the liquid and is operable to open the chamber and permit the liquid to mix with the additive in the mixing space and be dispensed to the exterior through the dispensing device. At least a portion of the wall of the dispensing device is penetrable by an injection member to form an aperture through which the additive may be introduced into the mixing space.

In some embodiments of the present invention, the penetrable portion of the wall is thermally resealable to thermally reseal the aperture after removal of the injection member therefrom to hermetically seal the additive within the mixing space. In some embodiments, a portion of the dispenser in fluid communication with the sealed chamber is penetrable by an injection member to form an aperture through which the liquid nutrition product may be introduced into the chamber. The penetrable portion is thermally resealable to seal the aperture after removal of the injection member therefrom to hermetically seal the liquid nutrition product within the chamber.

In accordance with another aspect, the present invention is directed to a dispenser comprising first means for forming a first hermetically sealed chamber aseptically filled with a first liquid nutrition product, and second means for forming a second hermetically sealed chamber aseptically filled with a second product. The dispenser further includes third means in fluid communication with the second hermetically sealed chamber for receiving a filling member, aseptically filling the second hermetically sealed chamber with a second product therethrough, and resealing after aseptically filling therethrough for hermetically sealing the second product within the second chamber. Fourth means are provided for moving at least one of the first means and the second means relative to the other between (i) a storage state in which the first and second chambers are hermetically sealed relative to each other for preventing intermixing of the first and second products, and (ii) a dispensing state in which the first and second chambers are in fluid communication with each other for intermixing and dispensing of the intermixed first and second products. The dispenser further includes fifth means in fluid communication with at least one of the first and second chambers in the dispensing state for dispensing the intermixed first and second products therethrough.

In some embodiments of the present invention, the first means is a first body portion defining the first hermetically sealed chamber; the second means is a second body portion defining the second hermetically sealed chamber; the third means is a penetrable and thermally resealable portion of the second body portion; the fourth means is defined by one of the first and second body portions being slidably mounted on the other and sealed relative thereto; and the fifth means is a dispensing device.

In accordance with another aspect, the present invention is directed to method comprising the following steps: (i) providing a device including a first body portion defining a first chamber; a second body portion defining a second filling portion and a second chamber in fluid communication with the second portion; wherein the first and second chambers define a storage state in which the first and second chambers are hermetically sealed relative to each other, and a dispensing state in which the first and second chambers are in fluid communication with each other; (ii) hermetically sealing within the first chamber a base liquid nutrition product; (iii) introducing a filling member into the second filling portion and aseptically filling the second chamber with an additive therethrough; and (iv) removing the filling member from the second filling portion and resealing the second filling portion to hermetically seal the additive therein.

In some embodiments of the present invention, the method further comprises moving at least one of the first and second chambers from (i) the storage state in which the base liquid nutrition product and additive are hermetically sealed relative to each other and are prevented from intermixing, to (ii) the dispensing state in which the first and second chambers are in fluid communication with each other. The method further comprises intermixing and dispensing of the intermixed base liquid nutrition product and additive.

Some embodiments of the present invention further comprise the steps of introducing a filling member into a first filling portion of the first body portion and aseptically filling the first chamber with the base liquid nutrition product therethrough; and removing the filling member from the first filling portion and resealing the first filling portion and hermetically sealing the base liquid nutrition product therein.

One advantage of the present invention is that the first liquid nutrition product and second product or additive can be aseptically filled in separate chambers that are hermetically sealed relative to each other, and thus prevented from intermixing during storage. Then, when ready for dispensing, the first and second chambers can be placed in fluid communication with each other to intermix the products and dispense the intermixed products. This is particularly advantageous for products that cannot or should not be intermixed during storage, such as probiotic supplements or other additives, and infant formulas or other base liquid nutrition products.

Other objects and advantages of the present invention and/or of the currently preferred embodiments thereof will become more readily apparent in view of the following detailed description of the currently preferred embodiments and accompanying drawings.

DETAILED DESCRIPTION OF THE INVENTION

Figure 2:
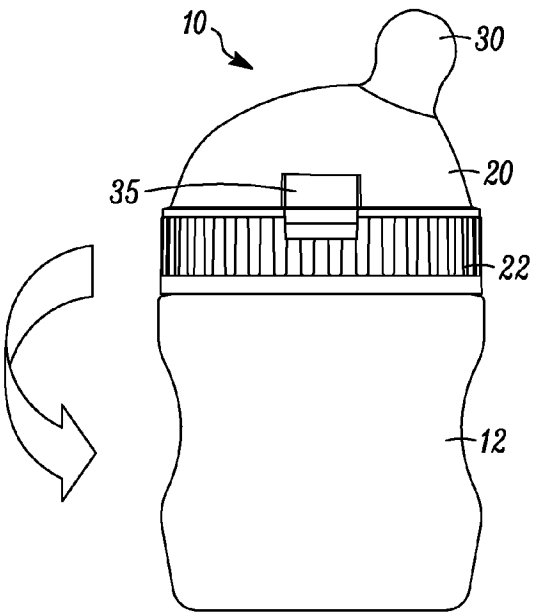
FIG. 2 is a side view of the container of FIG. 1.
Figure 1:
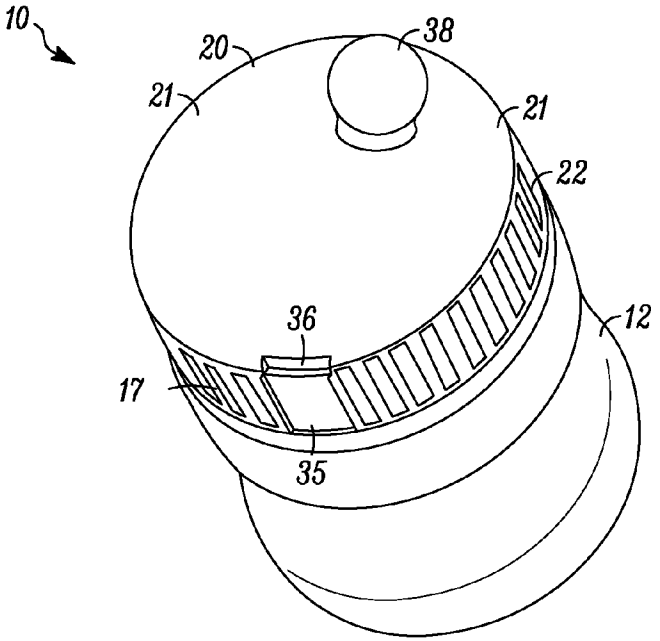
FIG. 1 is a top perspective view of a first embodiment of a container of the present invention.
Figure 3:
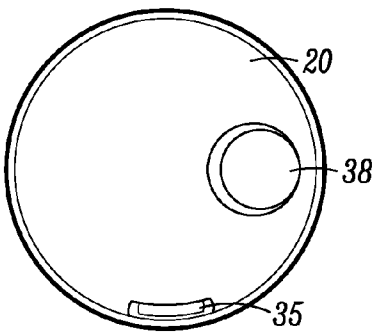
FIG. 3 is a top view of the container of FIG. 1.

In FIGS. 1-5, a container embodying the present invention is indicated generally by the reference numeral 10. The container 10 comprises a body 12 defining a chamber 14 for receiving a product or substance, and a container closure 20 including a peripheral gripping portion 22, and a sealing portion or secondary sealing member 26 (FIG. 4) extending about the periphery of the container closure and forming a substantially fluid-tight seal between the container closure and the body 12 to prevent leakage. The secondary sealing member 26 is received by at least one secondary annular groove 32 on the body 12 to effectuate the seal. In one embodiment, the secondary sealing member 26 is an elastomeric gasket; however, it should be noted that the secondary sealing member 26 can take on any of numerous forms and be made from any of numerous materials that are currently known, or that later become known, and are capable, for example, of forming a substantially fluid tight seal between the container closure 30 and container body 12. The container closure 20 further includes a securing portion or connecting flange 28 for movably securing the container closure 20 to the body 12 such that the container closure 20 and body are able to move relative to each other when secured together. In the illustrated embodiment, and by reference to FIGS. 4A and 7A-B, the container closure 20 and body 12 are snap fit together whereby the connecting flange 28 engages a primary annular groove 30 in the body 12; further, the container closure 20 and body rotate relative to each other. As may be recognized by those of ordinary skill in the pertinent art based on the teachings herein, the container closure 20 may be secured to the body 12 in any of numerous other ways that are currently known, or that later become known, such as by a threaded fit. For example, either the container closure or body can include one or more raised portions that are received within one or more recessed portions of the other for securing them together. Additionally, at least one of the container closure 20 and body 12 may move relative to the other in any of numerous other ways that are currently known, or that later become known, such as substantially vertically along the central or other axis of the container 10. Once the container closure 20 is secured to the container 10, the chamber 14 is sealed forming an empty sealed chamber.

Figure 4A:
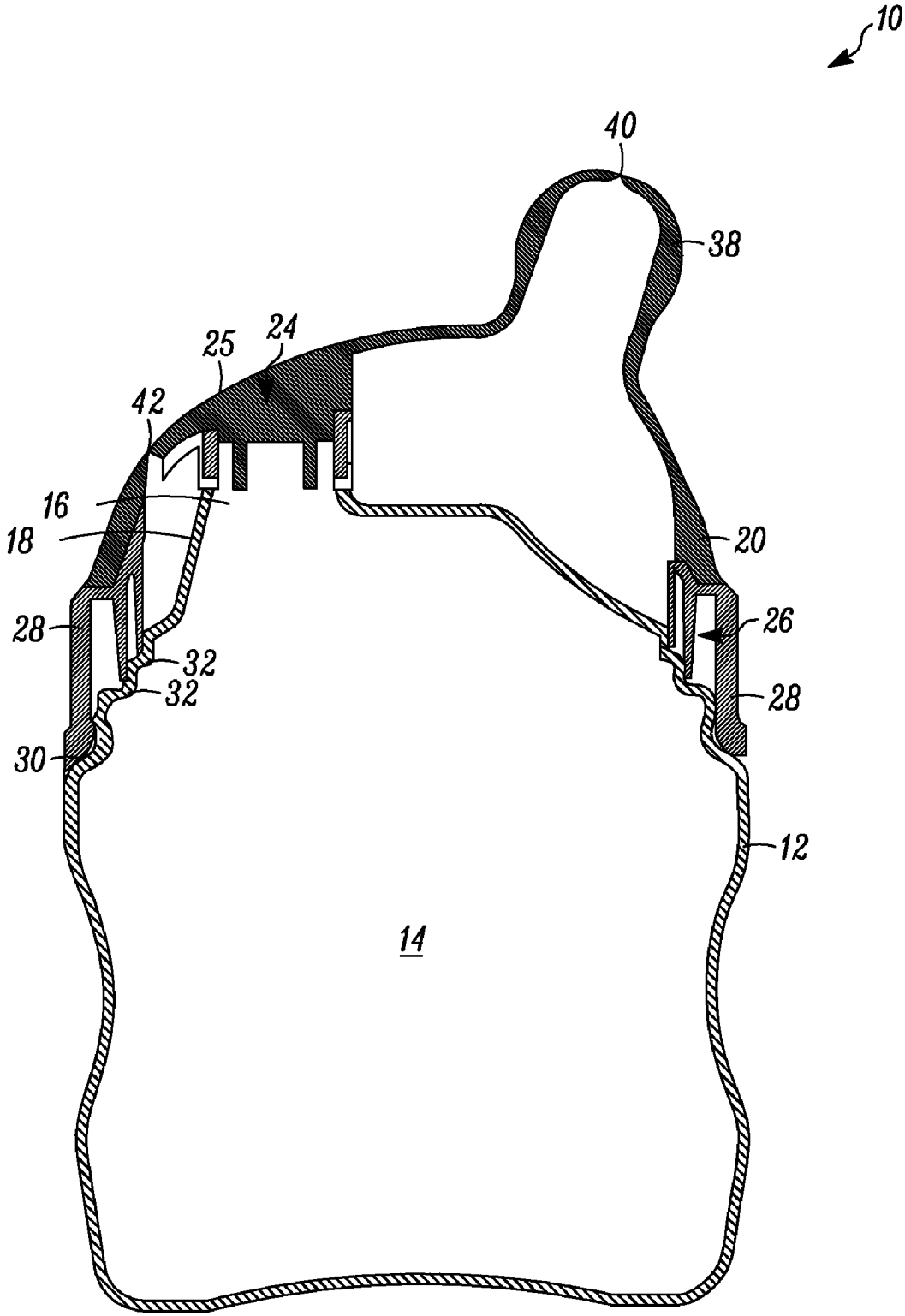
FIG. 4A is a cross-sectional view of the container of FIG. 1.
Figure 4B:
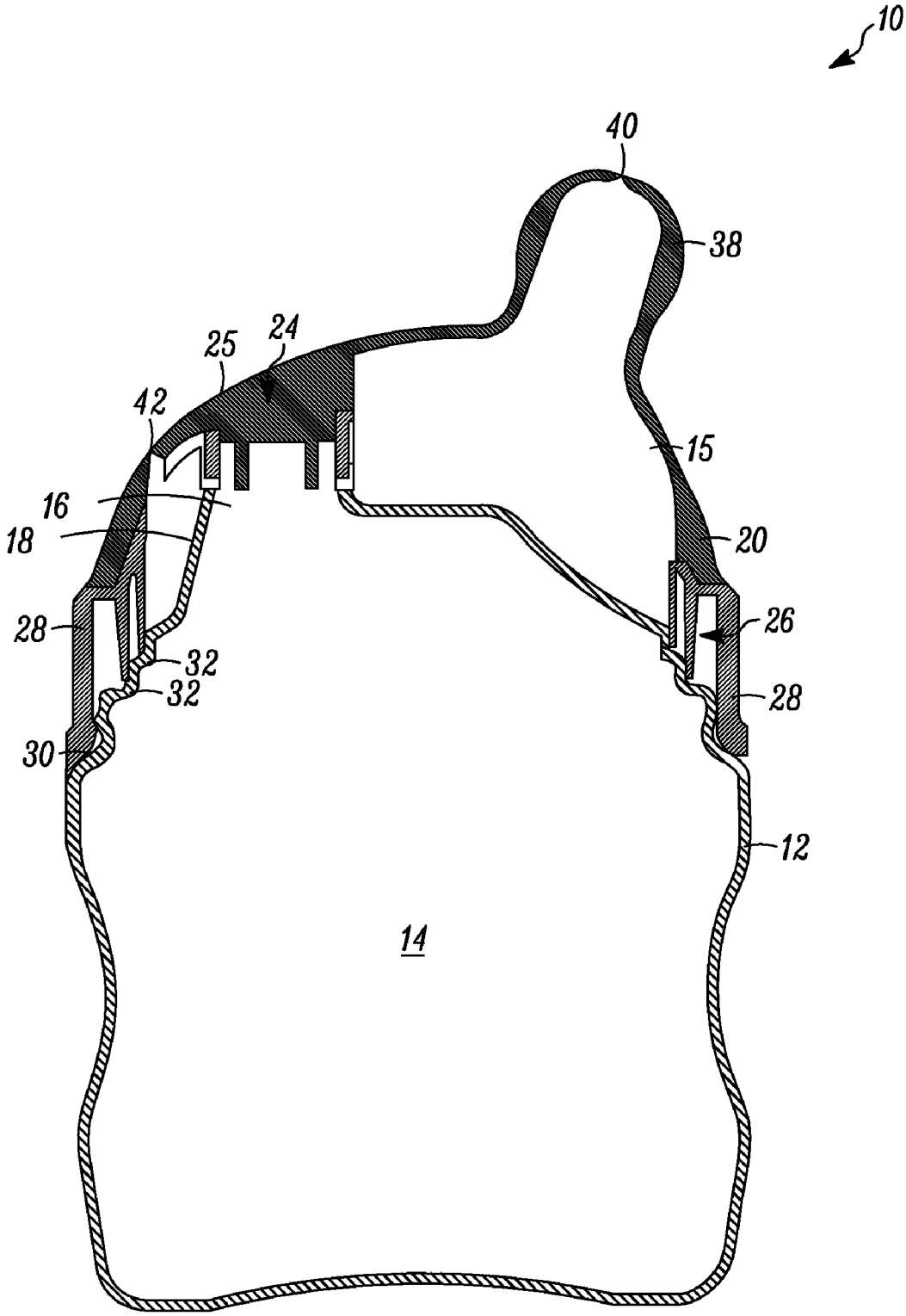
FIG. 4B is a cross-sectional view of the container if FIG. 1 showing an additional storage chamber.
Figure 5A:
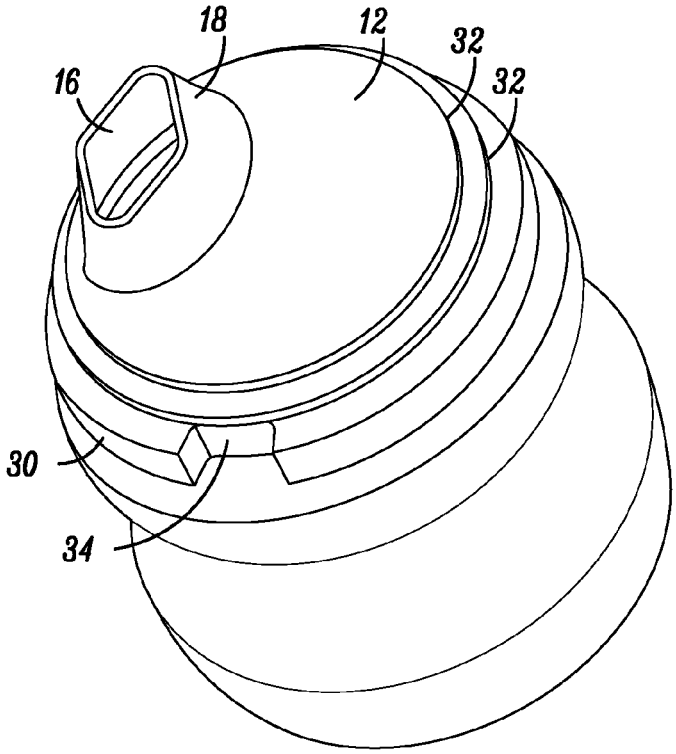
FIG. 5A is a top perspective view of the container of FIG. 1 with the container closure removed.
Figure 5B:
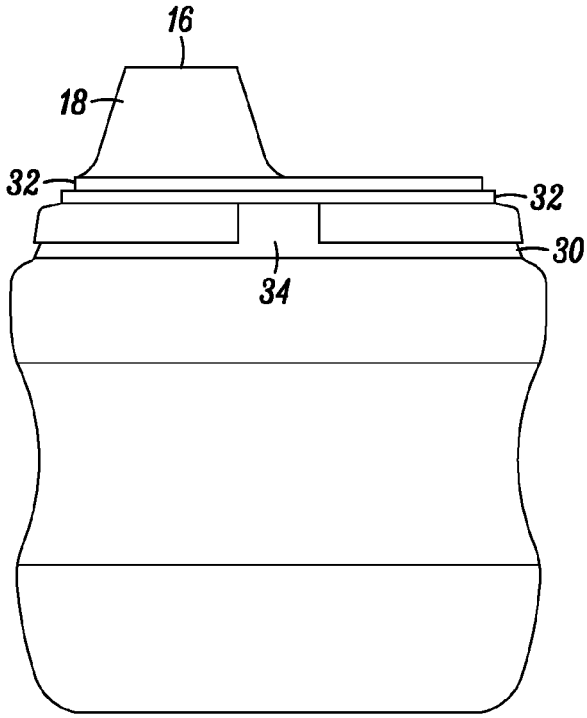
FIG. 5B is a side view of the container of FIG. 5A.

In addition, the container 10 may include any desired number of sealed empty chambers, including, for example, a first chamber 14 for receiving one or more first liquid components, and a second chamber 15 for receiving one or more second liquid components, as shown in FIG. 4B. In some such embodiments, the first and second chambers are initially sealed with respect to each other to maintain the first and second liquid components separate from each other during, for example, the shelf life of the product. Then, when the product is ready to be dispensed or used, the container includes a mechanism or feature to allow the first and second chambers to be placed in fluid communication with each other to allow mixing of the first and second liquid components at the time of use, or shortly before use.

The body 12 further defines an outflow port or opening 16 in fluid communication with the chamber 14. The outflow port 16 is typically circular, but can take on any shape or configuration; in one embodiment, the outflow port 16 has a raised periphery 18. A dispensing member 38 of the container closure 20 defines an outlet aperture 40 that is selectively connectable in fluid communication with the chamber 14 via the outflow port 16. The dispensing member 38 dispenses the product from the container 10 and can take on any of numerous different configurations that are currently known, or that later become known, such as a nipple (shown in the illustrated embodiment), a drinking spout (not shown), a drinking spout including a one-way check valve (not shown), wherein the check valve opens under negative pressure to allow the product to exit the outlet aperture, or a push-pull cap or sports bottle cap (not shown), wherein the outlet aperture is closed when the cap is in a retracted push position and the outlet aperture is open when the cap is in an extended pull position. As may be recognized by those of ordinary skill in the pertinent art based on the teachings herein, the dispensing member 38 can take on additional configurations that are currently known, or that later become known for dispensing products or substances from containers.

Figure 6B:
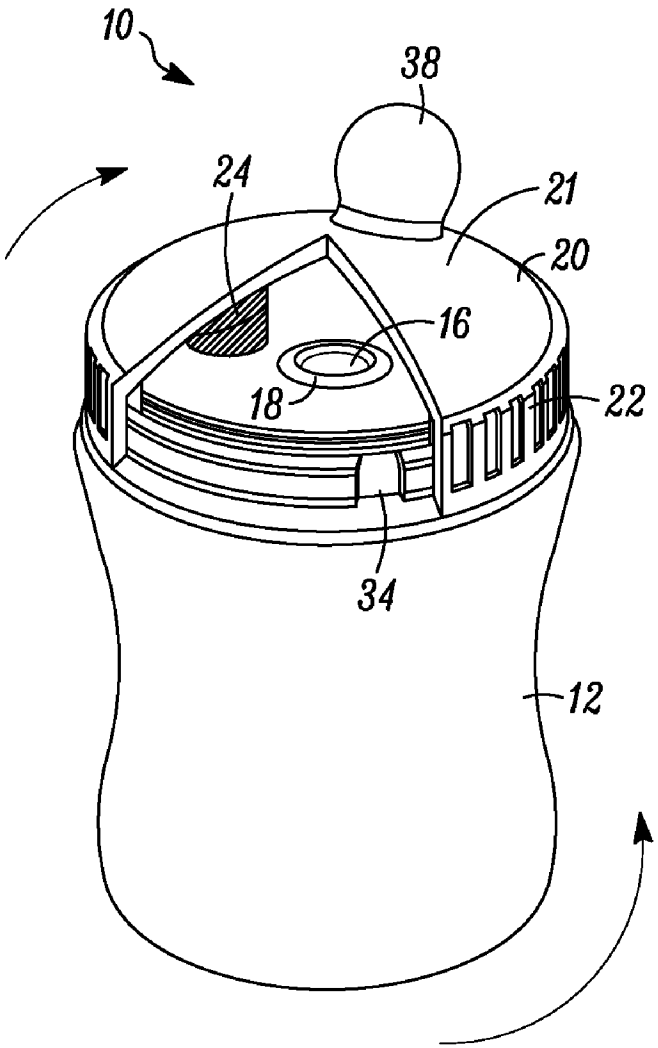
FIG. 6B is a side perspective view of the container of FIG. 1 with a portion of the container closure removed and showing the container closure in a second position.

To hermetically seal the product in the chamber 14 of the container 10, the container closure 20 employs a primary seal 24 or, in one embodiment, a stopper or septum 25, which is seated about and/or overlies the outflow port 16 when the closure is in the first position. As noted above, the container closure 20 is movable relative to the body 12 off the container. In the illustrated embodiment, the container closure 20 and body 12 rotate relative to each other along the longitudinal axis of the container 10 between a first position (FIG. 6A) where the primary seal 24 is seated about the outflow port 16 to hermetically seal the outflow port and thus the product in the chamber 14 during storage, and a second position (FIG. 6B) where the primary seal is displaced from the outflow port to allow product to pass from the chamber 14, in the illustrated embodiment, through the outflow port 16 and into the outlet aperture 40 to dispense the product. In one embodiment, the hermetic seal is created by the application of positive pressure asserted by the container closure on the primary seal 24 when the primary seal is in the first position. However, it should be noted that the primary seal 24 can be configured and/or positioned about and/or within the outflow port 16 to create a hermetic seal without the application of positive pressure, for example, by way of an interference fit between the primary seal and outflow port. For ease of use, the movement of the container closure 20 and body 12 relative to each other is configured such that when the second position is achieved, the container closure 20 and body will remain in the second position to prevent the primary seal 24 from sealing the outflow port 16 until moved back into the first position if so desired. To improve the flow of the product from the chamber 14 through the outlet aperture 40 in the dispensing member 38, a vent aperture 42 is provided in the container closure 20 to place the closure chamber in fluid communication with the ambient atmosphere.

Figure 6A:
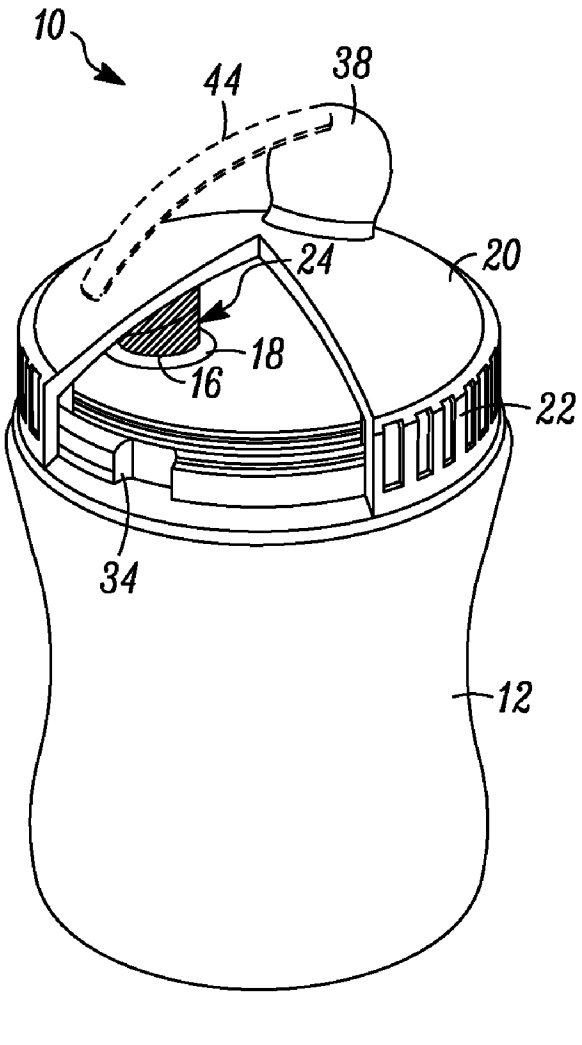
FIG. 6A is a side perspective view of the container of FIG. 1 with a portion of the container closure removed and showing the container closure in a first position.
Figure 9:
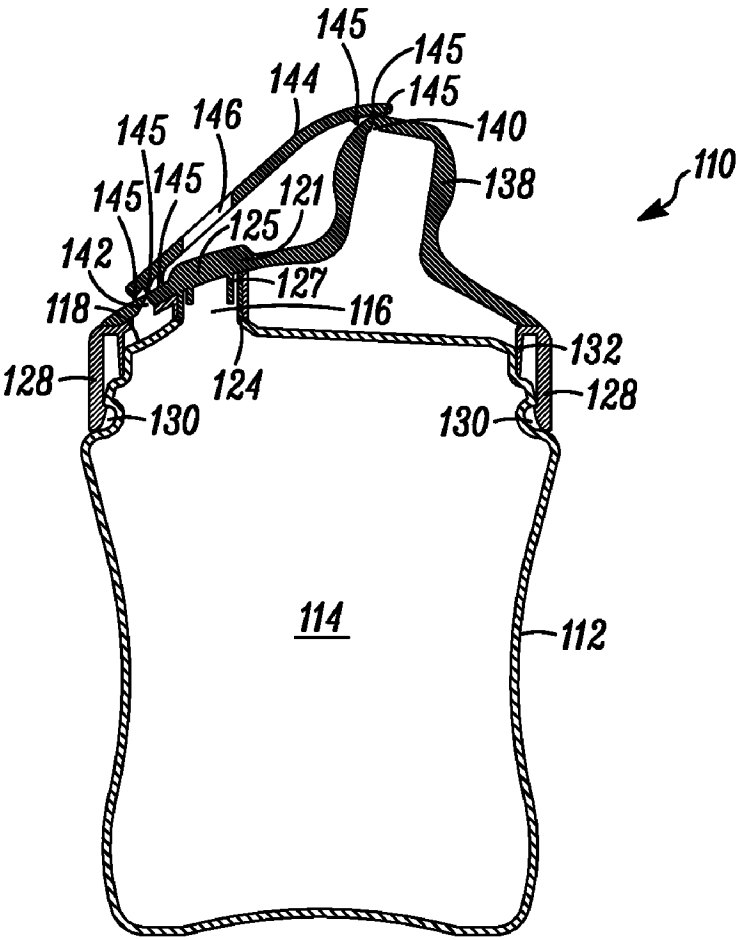
FIG. 9 is a cross-sectional view of the container of FIG. 8.
Figure 8:
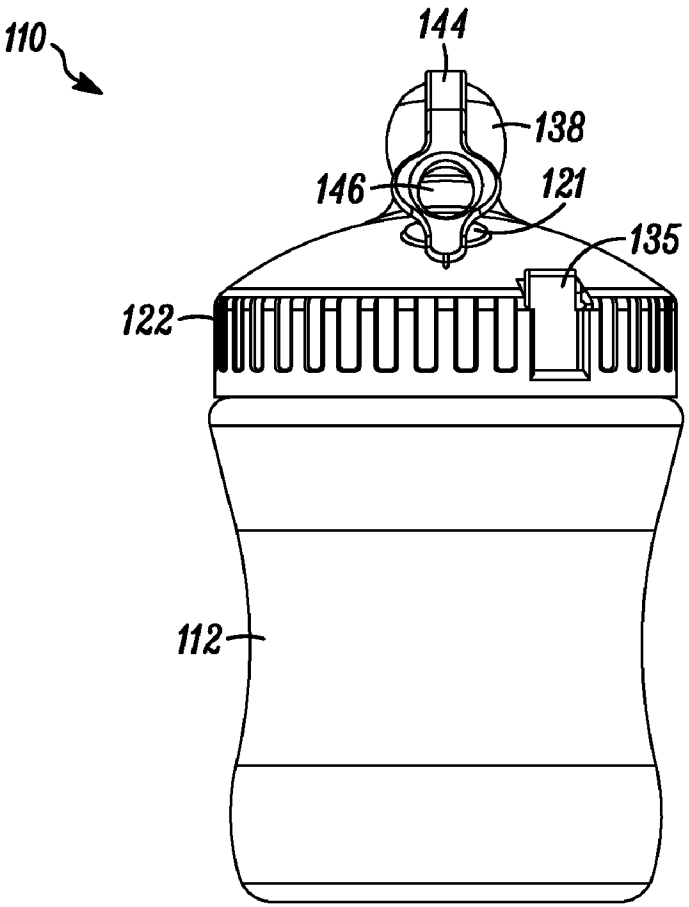
FIG. 8 is a front view of a second embodiment of a container of the present invention.

In an embodiment of the invention, and as shown in broken lines in FIG. 6A, the container closure 20 includes a sealing member 44 that is movable between a first position (FIG. 6A) sealing at least one of the dispensing member 38 and vent aperture 44, and a second (break away) position (FIG. 6B) opening at least one of the dispensing member 38 and vent aperture 44 to thereby allow product in the storage chamber 14 to be dispensed therethrough. In the illustrated embodiment, the sealing member 44 is connected to the dispensing member 38 and vent aperture 44 at least one frangible portion, and in one embodiment, three frangible portions (see, for example, sealing member 144 and frangible portions 146 of FIG. 9), which enables the user to break away the sealing member 144 with limited force, while at the same time requiring enough force to prevent accidental break away.

As can be seen, in the illustrated embodiment, the dispensing member 38 is a nipple positioned off center with respect to the central or longitudinal axis of the container 10. Positioning the nipple in this manner is by itself, or in combination with the vent aperture 44, advantageous in decreasing incidents of otitis in bottle feeding infants and young children by reducing negative pressure generated during sucking, which in turn, reduces harmful fluid build-up in the inner ear. More specifically, as can be seen, the nipple 38 is positioned off center, and the elongated axis of the nipple is oriented at an acute angle relative the central, elongated or longitudinal axis of the container. Preferably, the acute angle of the nipple relative to the longitudinal axis of the container is within the range of about 10° to about 45°, and in the illustrated embodiment, the acute angle is about 28°. As can be seen, the overall length of the nipple, and the acute angle of the nipple, are such that the distal or free end of the nipple does not extend laterally outside the outer diameter of the closure. In addition, the vent aperture 42 is laterally spaced relative to the nipple 38, and in the illustrated embodiments, is located substantially on the diametrically opposite side of the closure relative to the nipple. One advantage of this configuration of the nipple and vent aperture is that during dispensing, an air pocket develops within the closure adjacent to the vent aperture 42 that substantially prevents any liquid from flowing into the vent aperture during dispensing, allows any air within the chamber to vent through the vent aperture, and substantially prevents the air from venting through the nipple and otherwise causing, for example, a baby to suck air through the nipple. Accordingly, the eccentrically mounted nipple, and the vent aperture laterally spaced from the nipple, substantially prevents the formation of a vacuum within the nipple, the fluid dispensed through the nipple, or within the mouth of a baby sucking on the nipple. Further, because of the laterally spaced location of the vent aperture, the liquid does not block the vent aperture during dispensing, and thus does not give rise to undesirable cavitations within the nipple, the liquid or the mouth of a baby sucking on the nipple. As can be seen, the secondary sealing member 26 and nipple 38 are formed integral with each other from a first material, while the primary seal 24 is formed of a second material different than the first material. As may be recognized by those of ordinary skill in the pertinent art based on the teachings herein, the primary seal 24, nipple 38 and secondary sealing member 26 can be formed of the same material, and/or can be formed integral with each other, such as by co-molding.

Figure 18B:
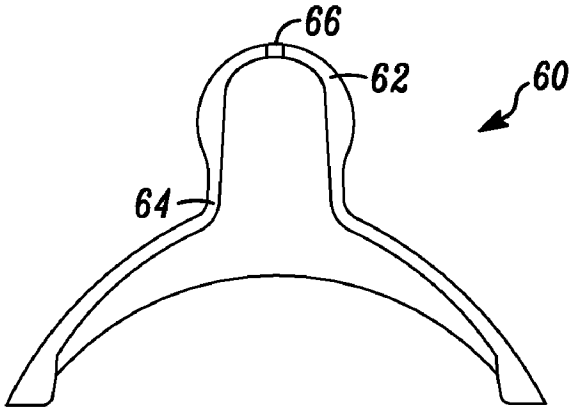
FIGS. 18A-F are side perspective and cross-sectional views of nipple variations.
Figure 18C:
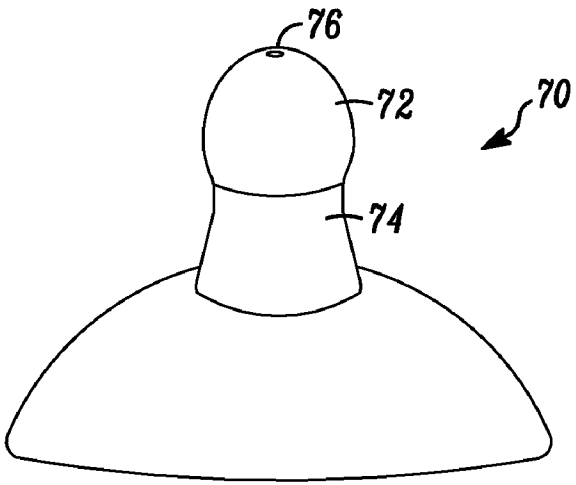
Figure 18A:
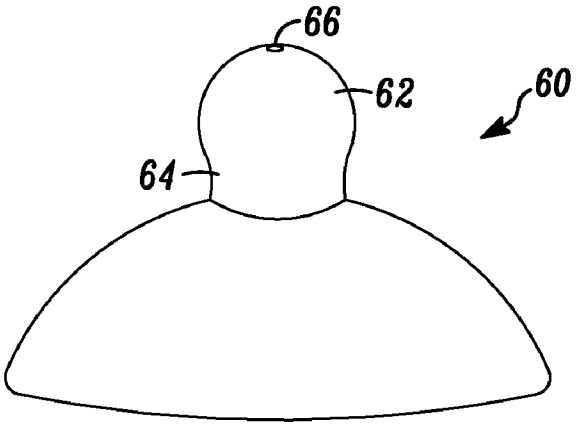
Figure 18E:
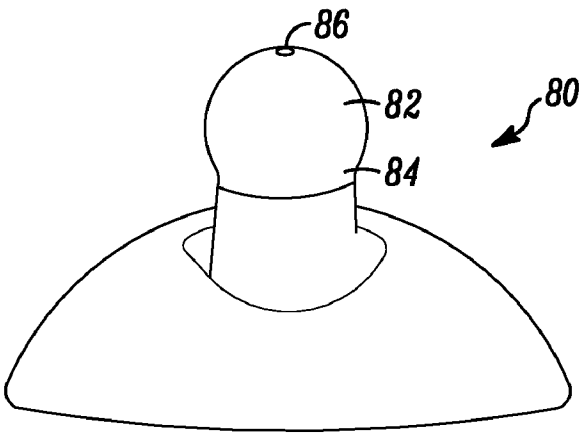
Figure 18F:
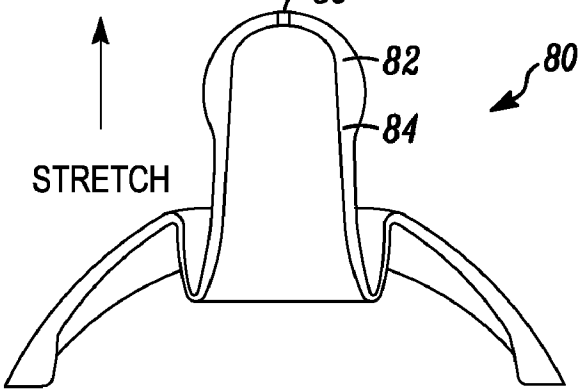
Figure 18D:
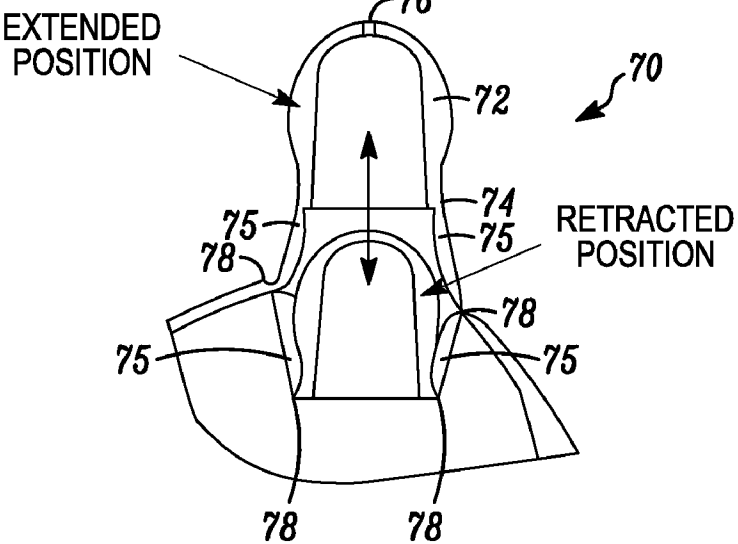

Referring to FIGS. 18A-F, various nipple configurations are shown, all of which represent different embodiments of the dispensing member 38. In FIGS. 18A-B, a round nipple 60 having an approximately round shaped tip 62 and a generally cylindrical stem 64 is shown. The nipple 60 is maintained in a single position during both storage and use. In FIGS. 18C-D, a second nipple configuration is shown. In this configuration, the nipple 70 has an approximately oval shaped tip 72 and a partially tapered generally cylindrical stem 74. The nipple 70 is a bi-stable nipple movable between two positions: a retracted position, wherein the nipple 70 remains at least partially retracted within the closure 20 during storage and/or non-use, and an extended position (or ready to feed position) wherein the nipple remains at least partially extended during use for dispensing the product. In the retracted position, a portion 75 of the stem 74 is inverted and self-stabilizing, allowing the nipple 70 to remain in the retracted position until the user engages the nipple and moves the nipple into the extended position. In the extended position, the portion 75 of the stem 74 is brought to a non-inverted position and, is again, self-stabilizing, allowing the nipple 70 to remain in the extended position until the user engages the nipple and moves the nipple into the retracted position if so desired. The nipple 70 defines at least one flex joint 78 which allows the nipple 70 to move between the two positions. In FIGS. 18E-F, a third nipple configuration is shown. In this configuration, the nipple 80 has an approximately round shaped tip 82 and a partially tapered generally cylindrical stem 84. The nipple 80 is a stretchable nipple that can be stretched between a recessed position, wherein the nipple 80 remains at least partially recessed within the closure 20 during storage and/or non-use, and an extended or stretched position wherein the nipple extends from the outer surface 21 of the container closure. The nipple 80 can dispense product in any position; i.e. whether the nipple is partially recessed, fully or partially stretched or any position therebetween. Each of the above-described nipples 60, 70, 80 defines a respective outlet aperture 66, 76, 86 for dispensing product therethrough and is in fluid communication with storage chamber 14 (FIG. 4A) or at least one of the storage chambers 14, 15 if multiple storage chambers are present (FIG. 4B). It should be noted that the shapes, profiles and sizes of the nipples 60, 70, 80 including the tips 62, 72, 82 and stems 64, 74, 84 can take on any of numerous shapes, profiles, sizes and combinations thereof that are currently known, or that later become known; for example, the nipple 60 can have a substantially oval-shaped tip 62 and a somewhat tapered stem 64, the nipple 70 can have a substantially round tip 72 and a generally cylindrical, non-tapered stem 74, etc. to customize the nipple for the comfort of the child.

In a currently preferred embodiment of the present invention, the product contained within the storage chamber 14 is a fat containing liquid product. The fat containing liquid product may be any of numerous different products that are currently known, or that later become known, including without limitation infant or baby formulas, growing-up milks, milks, creams, half-and-halfs, yoghurts, ice creams, juices, syrups, condiments, milk-based or milk-containing products, liquid nutrition products, liquid health care products, and pharmaceutical products. As can be seen in FIG. 4 and FIG. 6A, the primary seal 24 (second material portion) defines an internal surface in fluid communication with the chamber 14 at the outflow port 16 and forms at least most of the surface area of the container closure 20 that can contact any fat containing liquid product within the chamber 14, and that does not leach more than a predetermined amount of leachables into the fat containing liquid product or undesirably alter a taste profile of the fat containing liquid product.

The term "leachable" is used herein to mean any chemical compound (volatile or non-volatile) that leaches into the product within the container from a component of the container during the period of storage through expiry of the product. An exemplary leachable to be avoided in connection with fat containing liquid nutrition products, such as infant or baby formulas, is mineral oil. Accordingly, as indicated below, in the exemplary embodiments of the present invention, the container body and container closure are not made from materials containing mineral oil, or that contain sufficiently low amounts of mineral oil such that they do not leach mineral oil into the fat containing liquid nutrition product, or substantially do not leach mineral oil into the fat containing liquid nutrition product (i.e., if any mineral oil is leached into the product, any such amount is below the maximum amount permitted under applicable regulatory guidelines for the respective product, such as FDA or LFCA guidelines). In accordance with the currently preferred embodiments of the present invention, the primary seal does not leach more than a predetermined amount of leachables into the product. The predetermined amount of leachables is less than about 100 PPM, is preferably less than or equal to about 50 PPM, and most preferably is less than or equal to about 10 PPM.

Figure 7B:
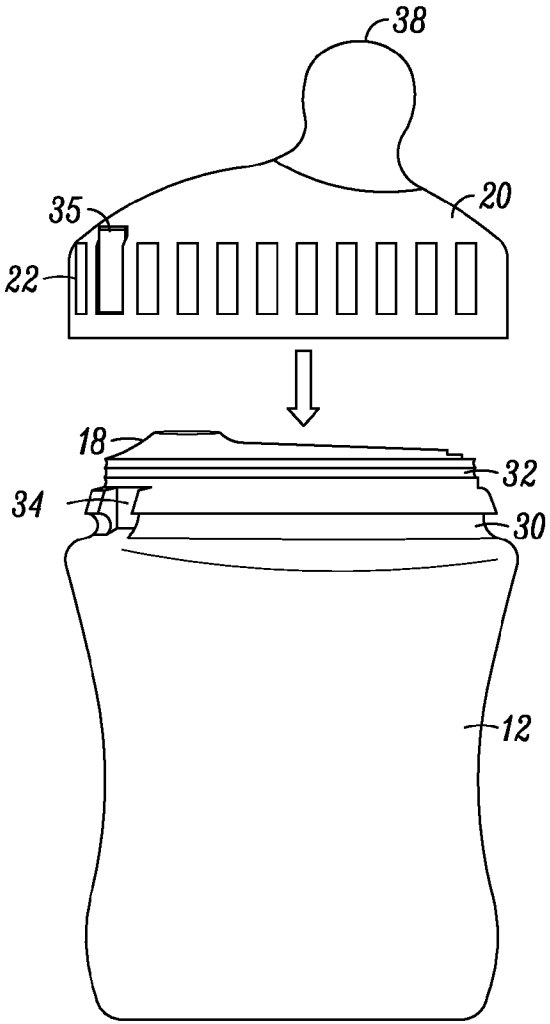
FIG. 7B is an exploded, side view of the container of FIG. 1.
Figure 7A:
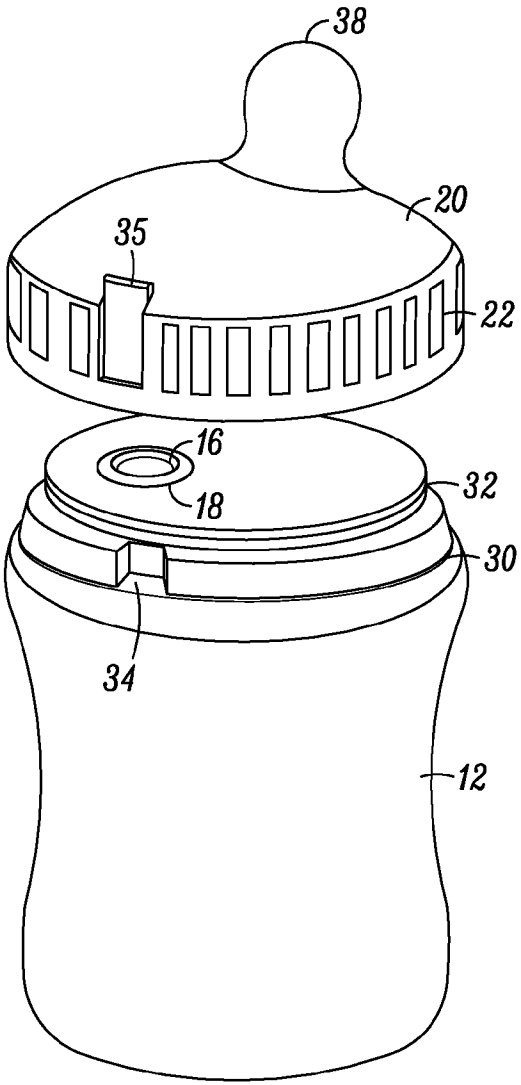
FIG. 7A is an exploded, side perspective view of the container of FIG. 1.

Drawing attention to FIGS. 7A-B, an exploded view of an embodiment of the container 10 is shown. In the illustrated embodiment, the body 12 is made from a blow molded polymer, such as polyethylene or polypropylene; however, it should be noted that the body 12 can be made from any of numerous different materials that are currently known, or that later become known, such as, for example, additional polymeric materials, metals, composites, or combinations thereof. In addition to the outflow port 16, the primary annular groove 30 and the secondary annular groove(s) 32, the body 12 defines a first tab recess 34 for receiving a breakaway tab 35, which is described in further detail below. The container closure 20 includes a co-molded outer portion, such as by insert molding, that comprises the gripping portion 22, a second tab recess 36, the break away tab 35 and the securing portion or connecting flange 28. The break away tab 35 is frangibly secured to the container closure in the second tab recess 36. The dispensing member 38, particularly in embodiments where a nipple is used, is co-molded, such as by over molding, to one or both of the primary and secondary seals. To fill the container 10, conventional sterilizing methods can be used whereby the body 12 and container closure 20 (and all other components associated with the container 10) are sterilized with heat, radiation, such as gamma or e-beam, and/or chemicals, such as fluid sterilants like vaporized hydrogen peroxide ("VHP"). If filled conventionally, a filling member such as a nozzle (not shown) is inserted through the outflow port 16 and the chamber 14 is filled with the desired amount of product or substance. The filling member is then removed and an additional sterilizing step is employed if required. Then, the container closure 20 is aligned and snap fit to the body 12 such that the breakaway tab 35 is received by the first tab recess 34, which locks the container closure in the first position relative to the body 12. In this assembled configuration, the primary seal 24 is positioned about the outflow port 16 (as noted above) such that the product in the chamber 14 is hermetically sealed. Additionally, the primary sealing member can be co-molded with the container closure.

If desired, the container closure may be molded in the same mold as the container body, or may be molded in adjacent molding machines, and at least one of the container closure and the body may be assembled within or adjacent to the mold in accordance with the teachings of U.S. Patent Application No. 60/551,565, filed Mar. 8, 2004, entitled "Apparatus and Method for Molding and Assembling Containers with Stoppers and Filling same"; U.S. patent application Ser. No. 11/074,454, filed Mar. 7, 2005, entitled "Method for Molding and Assembling Containers with Stoppers and Filling same"; U.S. patent application Ser. No. 11/074,513, filed Mar. 7, 2005, entitled Apparatus for Molding and Assembling Containers with Stoppers and Filling same; U.S. Patent Application Ser. No. 60/727,899 filed Oct. 17, 2005, entitled "Sterile De-Molding Apparatus And Method"; and U.S. patent application Ser. No. 11/582,291, filed Oct. 17, 2006, entitled "Sterile De-molding Apparatus and Method", each of which is hereby expressly incorporated by reference as part of the present disclosure. Alternatively, the closure and body may be co-molded by blow molding, such as by co-extrusion blow molding, wherein the molding process results in a sealed empty container defining one or more sterile chambers therein ready for aseptic filling, such as by needle filling and laser resealing, as disclosed in the following co-pending patent applications, which are hereby incorporated by reference in their entireties as part of the present disclosure: U.S. Application Ser. No. 61/104,649, filed Oct. 10, 2008, entitled "Co-Extrusion Blow Molding Apparatus and Method, and Sealed Empty Devices"; and U.S. Application Ser. No. 61/104,613, filed Oct. 10, 2008, entitled "Device with Co-Extruded Body and Flexible Inner Bladder and Related Apparatus and Method. One advantage of the devices, apparatus and methods disclosed in these patent applications is that the container is closed to define a sealed, empty sterile chamber at essentially the time of formation, and the container is never opened (through filling, resealing, and during shelf life) until the product is dispensed. Accordingly, a significantly high level of sterility assurance can be achieved. Alternatively, as described above, the sealed empty containers may be sterilized in any of numerous different ways that are currently known, or that later become known, such as by applying radiation, such as beta or gamma radiation, or by applying a fluid sterilant thereto, such as VHP.

In operation, in order to drink the product from the container 10, the user manually removes the sealing member 44 (if so equipped), which opens outlet aperture 40 of the dispensing member 38 and vent aperture 42, and then the breakaway tab 35, which unlocks the container closure 20. Next, while manually engaging the gripping portion 22 of the container closure 20 and a portion of the body 12, the user moves or, in the illustrated embodiment, rotates the container closure 20 relative to the body 12 from the first position where the primary seal 24 is seated about the outflow port 16 (outflow port closed and product hermetically sealed in chamber 14) to the second position where the primary seal 24 is displaced from the outflow port 16 (outflow port opened and product ready for dispensing) to allow product to pass from the chamber 14 through the outflow port 16 and into the outlet aperture 40 of the dispensing member 38 to dispense the product. It should be noted that in the illustrated embodiment, there are at least three options that that the user can employ to move the primary seal 24 from the first position to the second position to open the outflow port 16: (i) the user can grasp the body 12 to prevent movement thereof and rotate the container closure 20 in a first direction relative to the body 12; (ii) the user can grasp the container closure 20 to prevent movement thereof and rotate the body 12 in a second direction opposite the first direction relative to the container closure 20; (iii) the user can grasp both the container closure 20 and body 12 and simultaneously rotate the container closure 20 in the first direction and the body 12 in the second direction; or (iv) any combination thereof. As may be recognized by those of ordinary skill in the pertinent art based on the teachings herein, the design of the container closure 20 and/or body 12 is not limited to rotational movements, but rather can involve alternative movement configurations that are currently known, or that later become known capable of displacing the primary seal 24 from the first position to the second position. For example, the container closure 20 and/or body 12 can be moved in a linear or substantially vertical direction relative to each other.

Figure 15B:
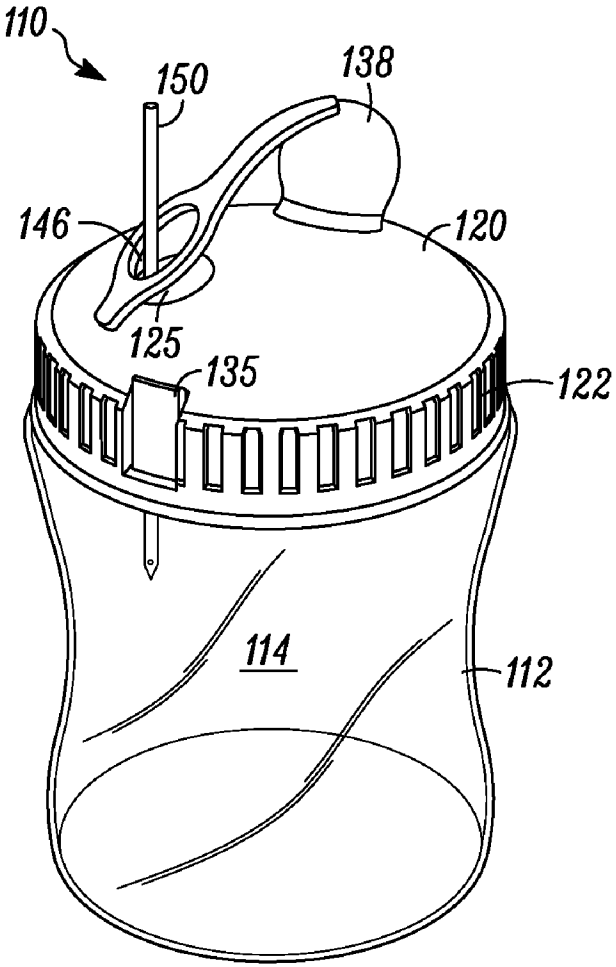
FIGS. 15A-C are top-side perspective views of the container of FIG. 8 during the filling stages.
Figure 15A:
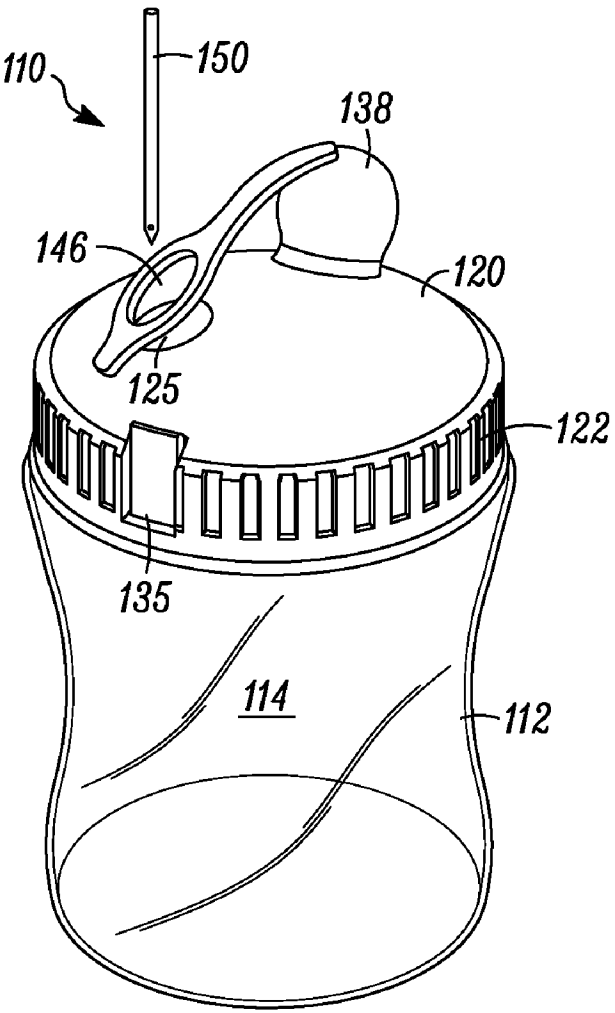
Figure 16A:
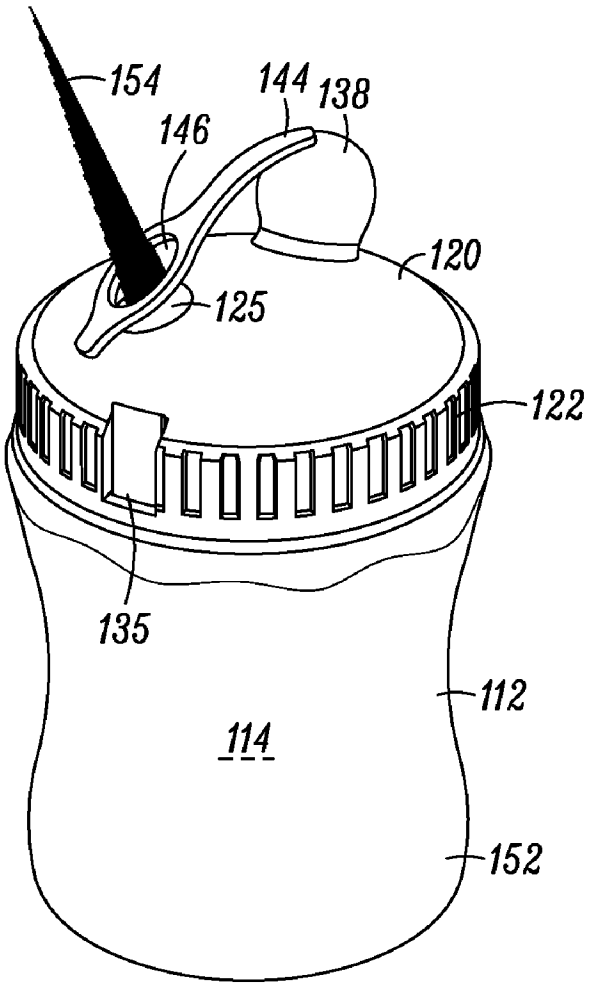
FIGS. 16A-B are top-side perspective views of the container of FIG. 8 during the laser resealing stages.
Figure 15C:
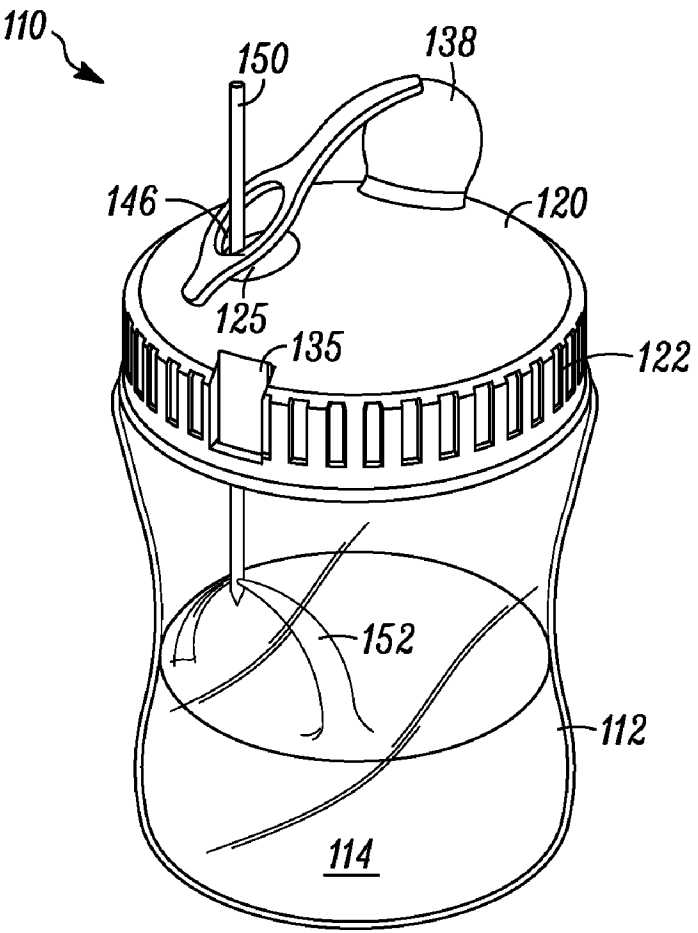
Figure 16B:
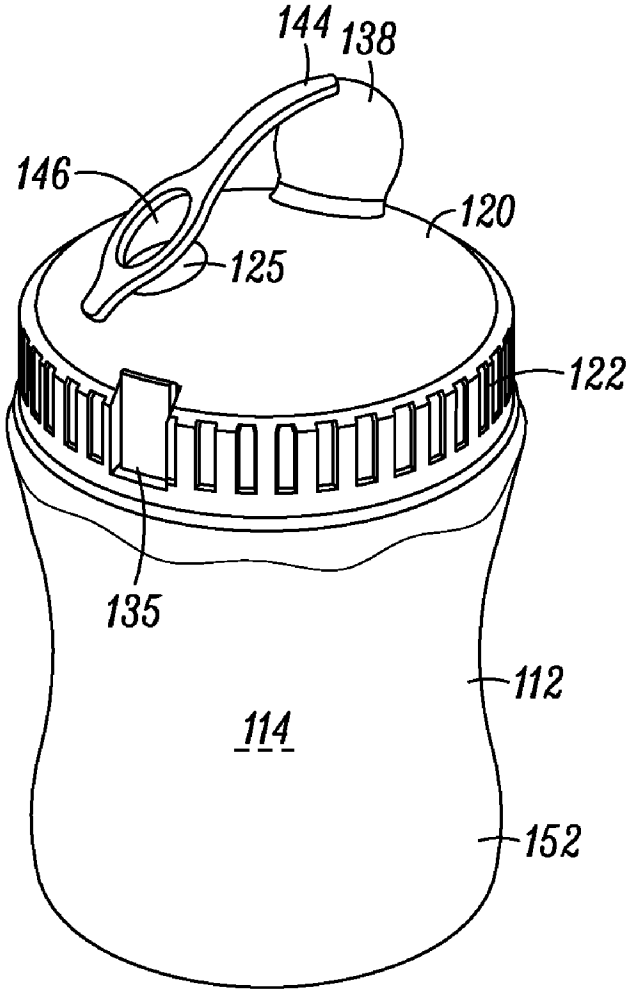
Figures 17A, 17B, 17C:
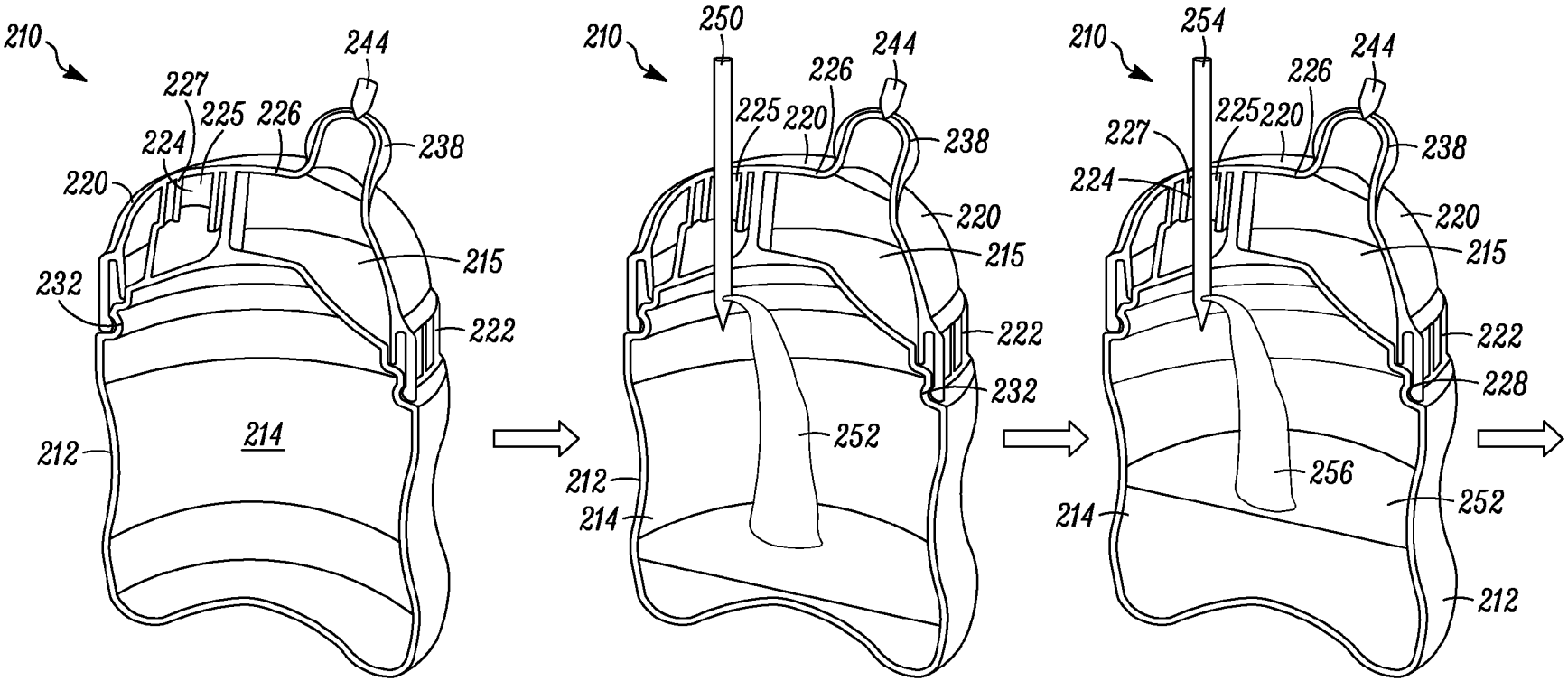
FIGS. 17A-F is a somewhat schematic illustration of an example of a method of filling, sealing and opening the containers of the present invention.
Figures 17D, 17E, 17F:
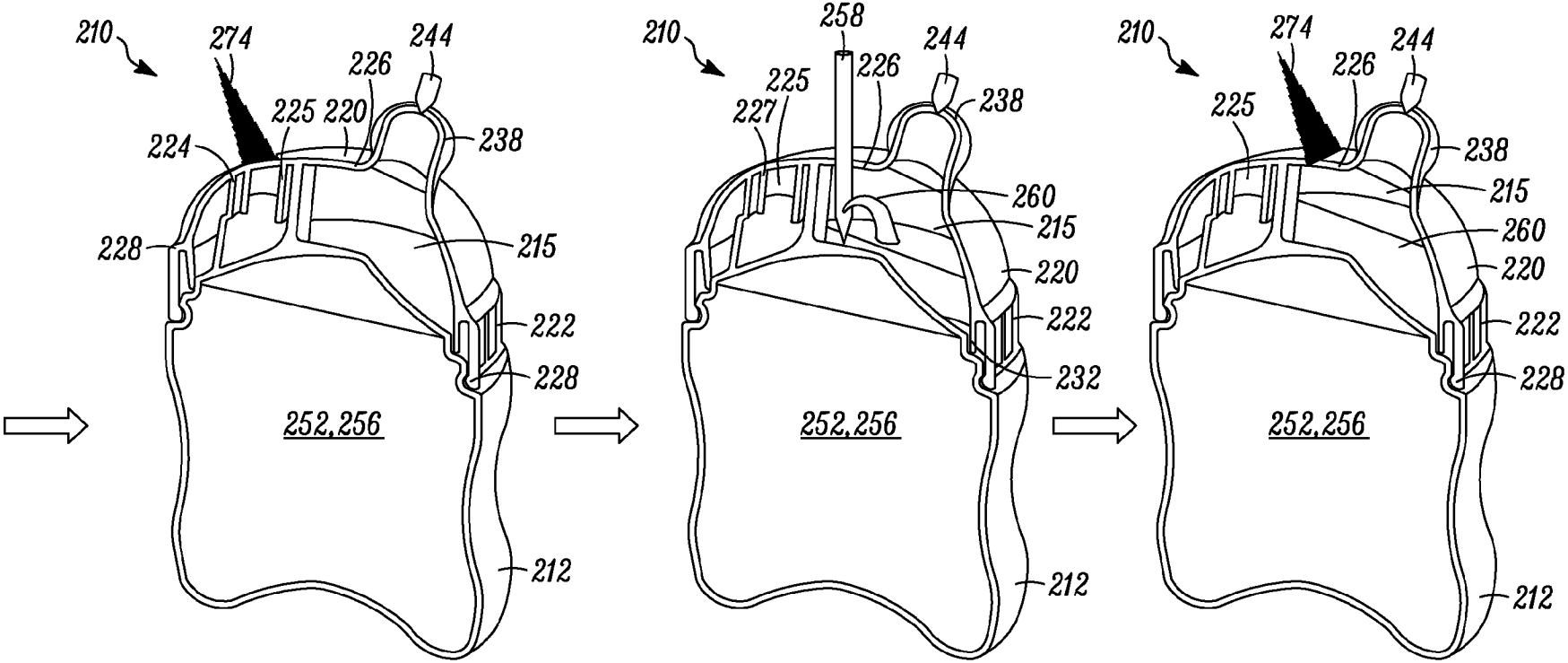

In FIGS. 8-14B another container embodying the present invention is indicated generally by the reference numeral 110. The container 110 is substantially similar to the container 10 described above with reference to FIGS. 1 through 7, and therefore like reference numerals preceded by the numeral "1" are used to indicate like elements. The primary difference of the container 110 in comparison to the container 10 is that the container closure and/or primary seal 124 further includes a penetrable and thermally resealable first filling portion or stopper 125. Starting with a sealed empty container 110, and providing at least one filling or injection member 150 in fluid communication with at least one storage device containing at least one product stored therein (not shown), the container 110 is aseptically filled by penetrating the stopper 125 with the injection or filling member 150, such as a filling needle (FIGS. 15A-B). The product is then injected (FIG. 15C) through the filling member and into the chamber 114. Upon filling the container 110, the filling member 150 is removed and a resulting penetration hole in the stopper 125 is thermally resealed, such as by the application of laser energy 154 thereto (FIGS. 16A), to seal the product within the container 110 (FIG. 16B) from the ambient atmosphere. The container 110 is then ready for shipping, storage and, ultimately, dispensing at the direction of the user. As shown in the illustrated embodiment, the primary seal 124 and/or stopper 125 and/or container closure 120 may include an optional annular injection member contacting surface 127 (FIG. 9) that contacts the injection or filling member 150 during withdrawal from the stopper 125 to substantially remove product thereon.

Figure 10B:
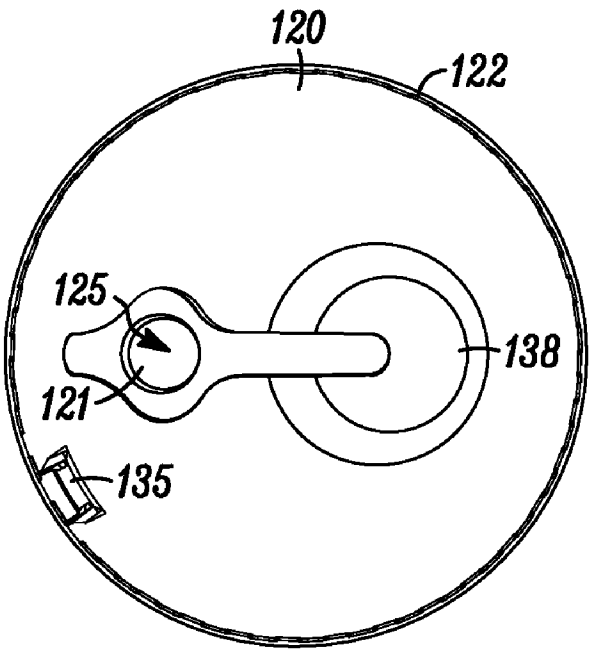
FIG. 10B is a top view of the container of FIG. 8.
Figure 10A:
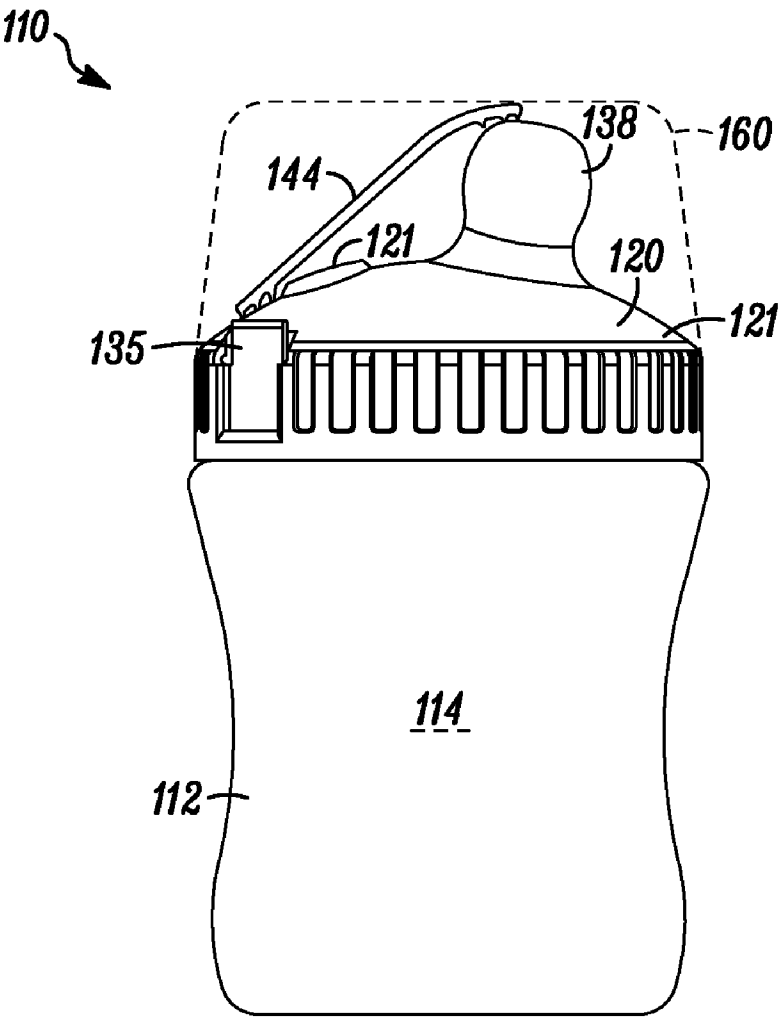
FIG. 10A is a side view of the container of FIG. 8.
Figure 12:
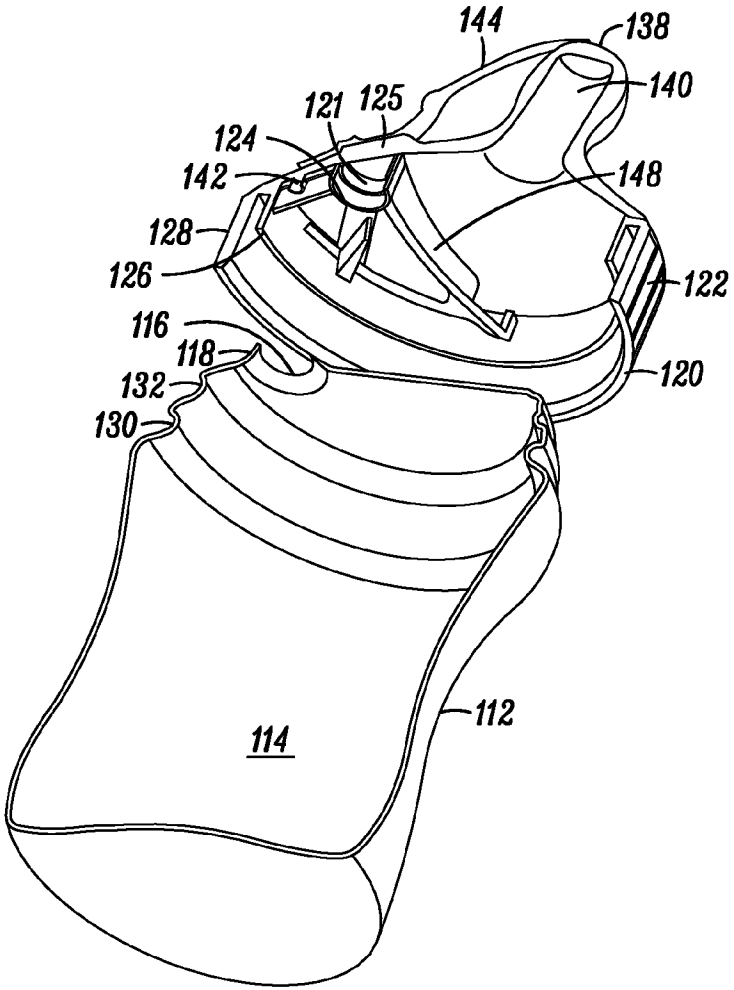
FIG. 12 is a side perspective cross-sectional view of the container of FIG. 8.
Figure 11:
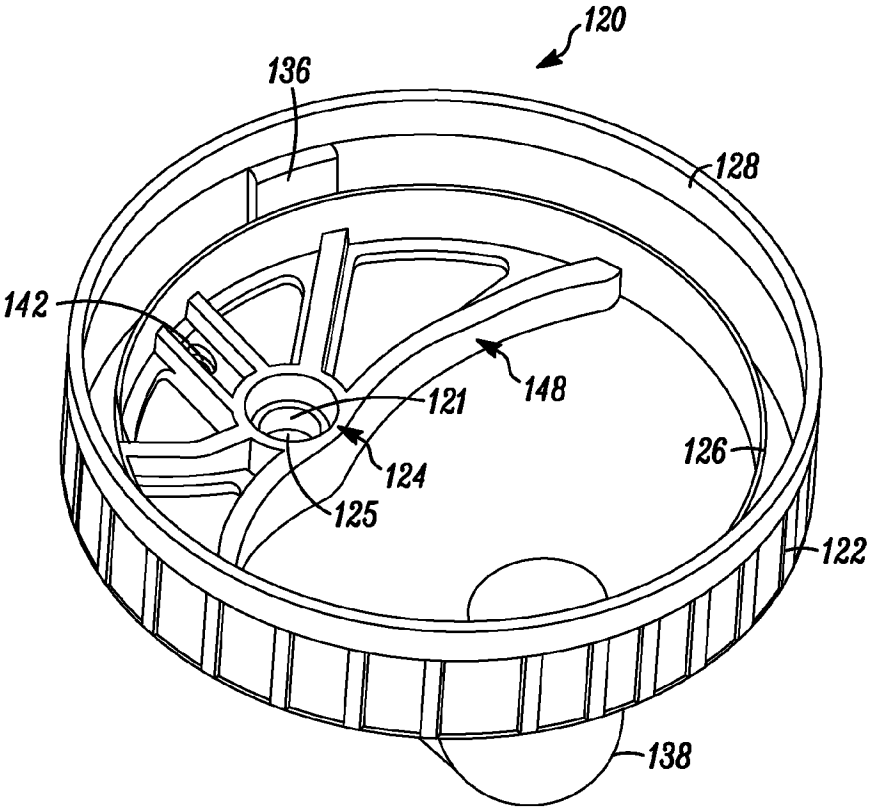
FIG. 11 is a bottom perspective view of the container closure of the container of FIG. 8.
Figure 13B:
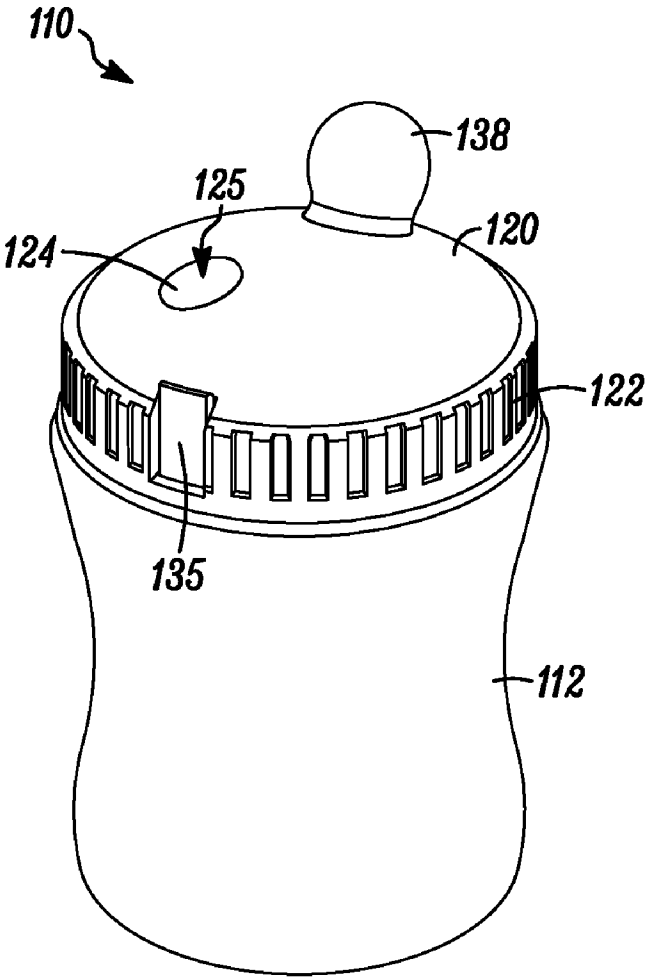
FIG. 13B is a top-side perspective view of the container of FIG. 8 with the sealing member removed.
Figure 13A:
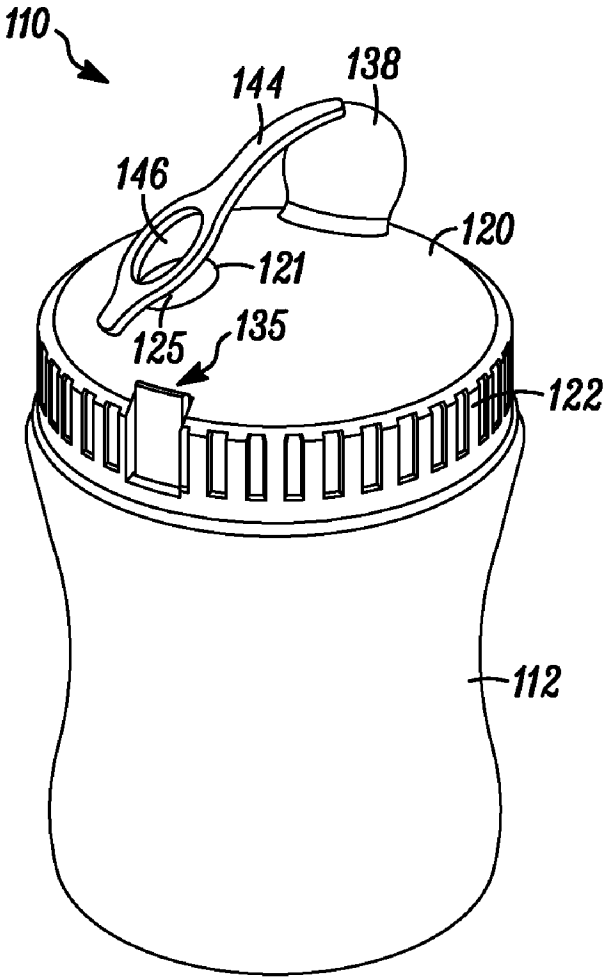
FIG. 13A is a top-side perspective view of the container of FIG. 8 with the sealing member attached.
Figure 14B:
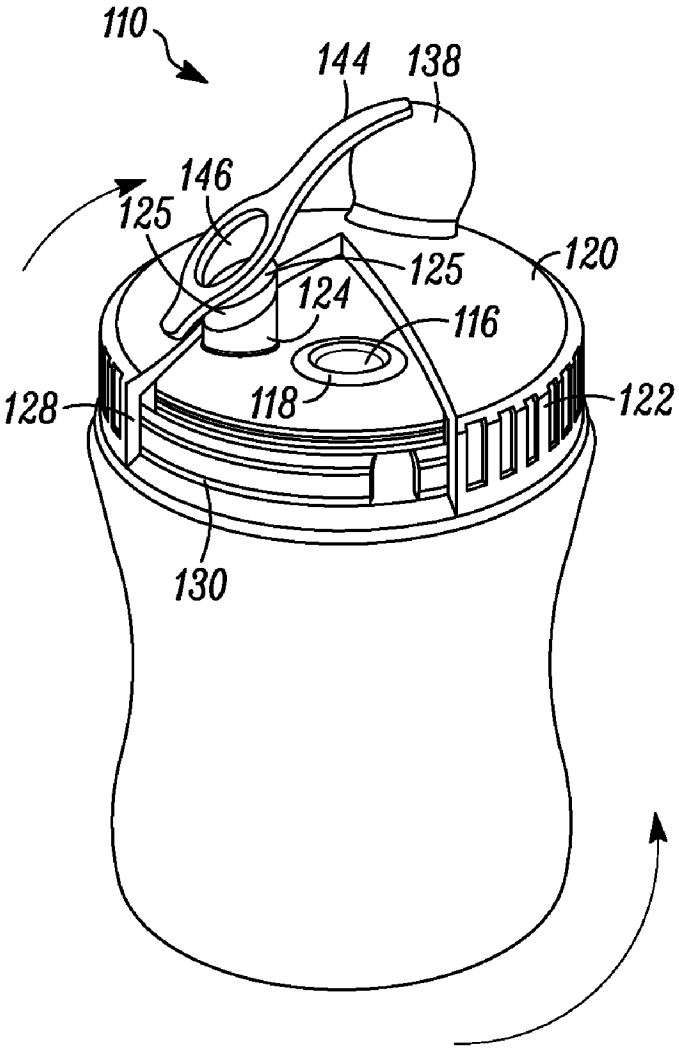
FIG. 14B is a side perspective view of the container of FIG. 8 with a portion of the container closure removed and showing the container closure in a second position.
Figure 14A:
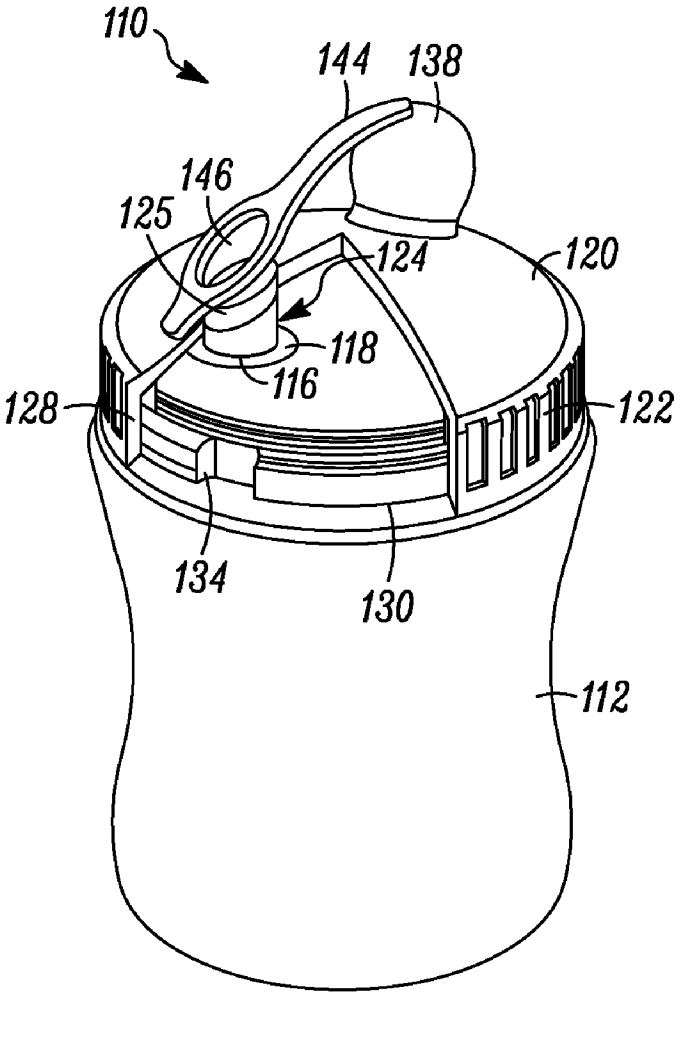
FIG. 14A is a side perspective view of the container of FIG. 8 with a portion of the container closure removed and showing the container closure in a first position.

In one embodiment of the container 110, the container includes an optional overcap 160 (shown in broken lines in FIG. 10A). The overcap 160 is attached mechanically or otherwise to at least one of the container closure 120 and container body 112. The overcap 160 provides an additional barrier to protect the container closure 120 and dispensing member 138 from contamination. The overcap 160 is designed to be removed by the consumer and may include a tear off strip or other mechanism (not shown) to indicate evidence of tampering. It should be noted that the overcap may also be used in conjunction with the container 10 described above and the container 210 described below.

Referring to FIGS. 17A-F, an example of a method of filling and resealing an embodiment of a container 210 of the present invention is shown. The container 210 is substantially similar to containers 10 and 110, and therefore like reference numerals preceded by the numeral "2" are used to indicate like elements. In the illustrated embodiment, the container 210 comprises two chambers 214, 215 and two resealable filling portions or stoppers, first stopper 225 and second stopper 226; however, it should be noted that in some embodiments, the container can comprise one or more chambers and one or more resealable portions or stoppers as desired. The first chamber 214 is defined within the container body 212 and the second chamber 215 is defined by a portion of the container body 212 in combination with a portion of the container closure 220; however, in an alternative embodiment, the second chamber 215 is wholly defined within the container closure 220.

The aseptic filling process starts with a sealed, empty container, defining one or more sealed, empty sterile chambers ready for aseptic filling therein of the product(s). The containers may be molded, such as by blow molding, so that the sealed, empty sterile chambers are created at the time of formation of sealed, empty container, in accordance with the teachings of the above-mentioned patent applications incorporated by reference herein. Alternatively, the sealed, empty containers may be sterilized such as by apply gamma or ebeam radiation thereon. Prior to filling, at least the external surfaces of the container that will contact the filling member are sterilized, such as by applying a fluid sterilant, such as VHP, or by applying radiation, such as ebeam radiation thereto. Alternatively, the sealed, empty sterile containers may be introduced into a sterile filling machine through a sterile transfer port. Then, starting with the container enclosure 220 assembled to container body 212 and the container 210 having at least two empty sterile sealed chambers 214, 215 (FIG. 17A), a filling member 250 is introduced into the first chamber 214 through the first stopper 225 and a resulting penetration aperture is created (not shown). In an alternative embodiment, a slit (not shown) is preformed in the stopper 225 for receiving the filling member. It should be noted that the penetration aperture and slit can take on numerous shapes and configurations that are currently known or that later become known. The filling member 250 is in fluid communication with a first liquid source (not shown) having a first liquid component 252. The first chamber 214 is then aseptically filled (FIG. 17B) with a desired volume of the first liquid component 252 and the first filling member 250 is removed therefrom. If desired, prior to filling the first chamber with the first liquid components, a purge may be performed by introducing an inert gas, such as nitrogen, into first chamber prior to aseptically filling the chamber with the product. The inert gas may be introduced with the same filling member as the liquid product, or may be introduced with a different filling member. Prior to introducing the inert gas, a vacuum may be drawn on the chamber through the filling member, if desired. Next, a second filling member 254 is introduced into the first chamber 214 through the aperture or slit. The second filling member 254 is in fluid communication with a second liquid source (not shown) having a second liquid component 256. The first chamber 214 is then aseptically filled (FIG. 17C) with a desired volume of the second liquid component 256 and, in turn, combined with the first liquid component to formulate a liquid product formulation within the sterile chamber 214 of the container 210. If desired, a purge likewise may be performed on the second chamber prior to filling. After the second filling member 254 is removed, the respective penetration aperture or slit in the resealable portion or stopper 225 is thermally resealed (FIG. 17D), such as by the application of laser energy 274 thereto, to hermetically seal the filled storage chamber 214 with respect to the ambient atmosphere. With the first chamber 214 filled and sealed, a third filling member 258 is introduced into the second chamber 215 through the second stopper 226 and a resulting penetration aperture is created (not shown). The third filling member 258 is in fluid communication with a third liquid source (not shown) having a third liquid component 260. The second chamber 215 is then aseptically filled (FIG. 17E) with a desired volume of the third liquid component 260. After the second chamber 215 is filled, the third filling member 258 is removed therefrom, and the penetration aperture or slit in the resealable portion or stopper 226 is thermally resealed (FIG. 17F), such as by the application of laser energy 274 thereto, to hermetically seal the filled storage chamber 215 with respect to the ambient atmosphere. After each fill, an inert gas may be pumped or otherwise released through the filling member prior to removing the filling member from the chamber to expel substantially all liquid through the filling member and into the chamber, and thereby prevent any dripping of liquid onto the container upon removal of the filling member therefrom. Alternatively, if, for example, a peristaltic pump is used to pump the liquid through the filling member, the pump can be reversed prior to withdrawing the filling member to create a suction or vacuum within the distal end of the filling member, and thereby prevent dripping of liquid therefrom and onto the container upon withdrawal of the filling member from the container.

When the product (i.e. liquid components) are ready for dispensing, the primary seal 224 is moved from the first position to the second as described above, thus opening the outflow port 16 and placing the first and second chambers 214 in fluid communication allowing the combination of liquid components to be dispensed through the outlet aperture 40.

In one embodiment of the present invention, the first liquid component 252 is a flavoring, such as vanilla, chocolate, coffee, fruit flavoring, a liquid sweetener, liquid vitamins and/or nutrients, combinations of these or any of numerous other flavorings, liquids, or additives that are currently known or that later become known; the second liquid 256 component is a base liquid, such as milk, baby formula, non-dairy milk substitutes, soy, water, fruit juice, cream, carbonated liquids, liquor, combinations of these or any of numerous other liquids that are currently known or that later become known; and the third liquid component 260 is a probiotic, vitamin or mineral supplement and/or medicament. The dispenser disclosed herein is particularly advantageous for storing and dispensing liquid nutrition products. For example, in some embodiments the liquid nutrition product, such as an infant formula or a growing up milk, is aseptically filled into the first chamber 214, and an additive, such as a dietary or nutritional supplement, such as a probiotic, is filled into the second chamber 215. In some embodiments, the liquid nutrition or other product is filled by filling in series a plurality of product components or ingredients into the same chamber, such as one fill with heat sterilized components, and another fill with cold sterilized components, as disclosed, for example, in the following co-pending patent applications that are hereby incorporated by reference in their entireties as part of the present disclosure: U.S. Application Ser. No. 60/997,675, filed Oct. 4, 2007, entitled "Apparatus and Method for Formulating and Aseptically Filling Liquid Products", U.S. application Ser. No. 12/245,678, filed Oct. 3, 2008, entitled "Apparatus for Formulating and Aseptically Filling Liquid Products" and U.S. application Ser. No. 12/245,681, filed Oct. 3, 2008, entitled "Method for Formulating and Aseptically Filling Liquid Products". One of the advantages of having multiple chambers that are sealed from the ambient atmosphere and from each other is that the liquid components and/or substances in each chamber can be stored as required to best preserve quality, integrity and freshness. For example, probiotics and other substances best maintained in an oil base such as, for example, a food grade oil, can be stored in one chamber, while substances best maintained in a non-oil base, such as, for example, in a water base, can be stored in another chamber. In this manner, the substance(s) in each chamber only interact when the primary seal is displaced from the outlet port, which occurs, for example, when the container closure 20 is moved from the first position to the second position just prior to ingestion/consumption to avoid premature spoilage or a degradation in quality and freshness or, in the case of probiotics, avoid destroying the active ingredients.

It should be known that the filling method described above can include an infinite number of liquid sources, liquid components and respective filling members, and the containers can be filled with any one liquid component, any combination of selected liquid components or, if desired, all available liquid components, in any available chamber and in any order.

The sterile, empty container and closure assemblies 10 may be filled and thermally resealed in accordance with the teachings of any of the following patent applications and patents that are hereby incorporated by reference in their entireties as part of the present disclosure: U.S. Provisional Patent Application Ser. No. 60/981,107, filed Oct. 19, 2007, entitled "Container Having a Closure and Removable Resealable Stopper for Sealing a Substance Therein and Related Method," U.S. patent application Ser. No. 12/245,678, filed Oct. 3, 2008, entitled "Apparatus for Formulating and Aseptically Filling Liquid Products" and U.S. patent application Ser. No. 12/245,681, filed Oct. 3, 2008, entitled "Method for Formulating and Aseptically Filling Liquid Products," which claim the benefit of U.S. Provisional Patent Application Ser. No. 60/997,675, filed Oct. 4, 2007, entitled "Apparatus and Method for Formulating and Aseptically Filling Liquid Products," U.S. patent application Ser. No. 11/339,966, filed Jan.

25, 2006, entitled "Container closure with Overlying Needle Penetrable and Thermally Resealable Portion and Underlying Portion Compatible with Fat Containing Liquid Product, and Related Method," U.S. patent application Ser. No. 11/879,485, filed Jul. 16, 2007, entitled "Device with Needle Penetrable and Laser Resealable Method, and Related Portion," which is a continuation of similarly titled U.S. patent application Ser. No. 11/408,704, now U.S. Pat. No. 7,243,689, issued Jul. 17, 2007, which is continuation of U.S. patent application Ser. No. 10/766,172 filed Jan. 28, 2004, entitled "Medicament Vial Having A Heat-Sealable Cap, And Apparatus and Method For Filling The Vial", now U.S. Pat. No. 7,132,631, issued Apr. 25, 2006, which is a continuation-in-part of similarly titled U.S. patent application Ser. No. 10/694,364, filed Oct. 27, 2003, now U.S. Pat. No. 6,805,170, issued Oct. 19, 2004, which is a continuation of similarly titled co-pending U.S. patent application Ser. No. 10/393,966, filed Mar. 21, 2003, which is a divisional of similarly titled U.S. patent application Ser. No. 09/781,846, filed Feb. 12, 2001, now U.S. Pat. No. 6,604,561, issued Aug. 12, 2003, which, in turn, claims the benefit of similarly titled U.S. Provisional Application Ser. No. 60/182,139, filed Feb. 11, 2000; similarly titled U.S. Provisional Patent Application No. 60/443,526, filed Jan. 28, 2003; similarly titled U.S. Provisional Patent Application No. 60/484,204, filed Jun. 30, 2003; U.S. patent application Ser. No. 10/655,455, filed Sep. 3, 2003, entitled "Sealed Containers And Methods Of Making And Filling Same," U.S. patent application Ser. No. 10/983,178, filed Nov. 5, 2004, entitled "Adjustable Needle Filling and Laser Sealing Apparatus and Method; U.S. patent application Ser. No. 11/901,467, filed Sep. 17, 2007, entitled "Apparatus and Method for Needle Filling and Laser Resealing", which is a continuation of similarly titled U.S. patent application Ser. No. 11/510,961, filed Aug. 28, 2006, now U.S. Pat. No. 7,270,158 issued Sep. 18, 2007, which is a continuation of similarly titled U.S. patent application Ser. No. 11/070,440, filed Mar. 2, 2005, now U.S. Pat. No. 7,096,896, issued Aug. 29, 2006, U.S. patent application Ser. No. 11/074,513 filed Mar. 7, 2005, entitled "Apparatus for Molding and Assembling Containers with Stoppers and Filling Same," and U.S. patent application Ser. No. 11/074,454, filed Mar. 7, 2005, entitled "Method for Molding and Assembling Containers with Stoppers and Filling Same," U.S. patent application Ser. No. 11/786,206, filed Apr. 10, 2007, entitled "Ready to Drink Container with Nipple and Needle Penetrable and Laser Resealable Portion, and Related Method"; and U.S. application Ser. No. 11/804,431, filed May 18, 2007, entitled "Delivery Device with Separate Chambers Connectable in Fluid Communication When Ready for Use, and Related Method".

In the illustrated embodiment of the invention, the needle penetrable and thermally resealable portions or stoppers 125, 225, 226 are preferably made of a thermoplastic/elastomer blend, and may be the same material as those described in the co-pending patent applications and/or patents incorporated by reference above. Accordingly, in one such embodiment, the penetrable and thermally resealable portion or stopper is a thermoplastic elastomer that is heat resealable to hermetically seal the needle aperture by applying laser radiation at a predetermined wavelength and power thereto, and defines (i) a predetermined wall thickness, (ii) a predetermined color and opacity that substantially absorbs the laser radiation at the predetermined wavelength and substantially prevents the passage of radiation through the predetermined wall thickness thereof, and (iii) a predetermined color and opacity that causes the laser radiation at the predetermined wavelength and power to hermetically seal the needle aperture formed in the needle penetration region thereof in a predetermined time period of less than or equal to about 5 seconds and substantially without burning the needle penetration region.

In one embodiment, the penetrable and thermally resealable portion or stopper is a thermoplastic elastomer that is heat resealable to hermetically seal the needle aperture by applying laser radiation at a predetermined wavelength and power thereto, and includes (i) a styrene block copolymer; (ii) an olefin; (iii) a predetermined amount of pigment that allows the penetrable and thermally resealable portion to substantially absorb laser radiation at the predetermined wavelength and substantially prevent the passage of radiation through the predetermined wall thickness thereof, and hermetically seal the needle aperture formed in the needle penetration region thereof in a predetermined time period of less than or equal to about 5 seconds; and (iv) a predetermined amount of lubricant that reduces friction forces at an interface of the needle and the penetrable and thermally resealable portion or stopper portion during needle penetration thereof. In one such embodiment, the penetrable and thermally resealable portion or stopper includes less than or equal to about 40% by weight styrene block copolymer, less than or equal to about 15% by weight olefin, less than or equal to about 60% by weight mineral oil, and less than or equal to about 3% by weight pigment and any processing additives of a type known to those of ordinary skill in the pertinent art. The term "pigment" is used herein to mean any of numerous different substances or molecular arrangements that enable the material or material portion within which the substance or molecular arrangement is located to substantially absorb laser radiation at the predetermined wavelength and, in turn, transform the absorbed energy into heat to melt the respective material forming the penetrable and thermally resealable portion or stopper and resealing an aperture formed therein.

In one embodiment, the penetrable and thermally resealable portion or stopper is a thermoplastic elastomer that is heat resealable to hermetically seal the needle aperture by applying laser radiation at a predetermined wavelength and power thereto, and includes (i) a first polymeric material in an amount within the range of about 80% to about 97% by weight and defining a first elongation; (ii) a second polymeric material in an amount within the range of about 3% to about 20% by weight and defining a second elongation that is less than the first elongation of the first polymeric material; (iii) a pigment in an mount that allows the penetrable and thermally resealable portion or stopper to substantially absorb laser radiation at the predetermined wavelength and substantially prevent the passage of radiation through the predetermined wall thickness thereof, and hermetically seal a needle aperture formed in the needle penetration region thereof in a predetermined time period of less than or equal to about 5 seconds; and (iv) a lubricant in an amount that reduces friction forces at an interface of the needle and second material portion during needle penetration thereof.

In one embodiment of the invention, the pigment is sold under the brand name Lumogen™ IR 788 by BASF Aktiengesellschaft of Ludwigshafen, Germany. The Lumogen IR products are highly transparent selective near infrared absorbers designed for absorption of radiation from semiconductor lasers with wavelengths near about 800 nm. In this embodiment, the Lumogen pigment is added to the elastomeric blend in an amount sufficient to convert the radiation to heat, and melt the stopper material, preferably to a depth equal to at least about ⅓ to about ½ of the depth of the needle hole, within a time period of less than or equal to about 5 seconds, preferably less than about 3 seconds, and most preferably less than about 1½ seconds. The Lumogen IR 788 pigment is highly absorbent at about 788 nm, and therefore in connection with this embodiment, the laser preferably transmits radiation at about 788 nm (or about 800 nm). One advantage of the Lumogen IR 788 pigment is that very small amounts of this pigment can be added to the elastomeric blend to achieve laser resealing within the time periods and at the resealing depths required or otherwise desired, and therefore, if desired, the needle penetrable and laser resealable stopper may be transparent or substantially transparent. This may be a significant aesthetic advantage. In one embodiment of the invention, the Lumogen IR 788 pigment is added to the elastomeric blend in a concentration of less than about 150 ppm, is preferably within the range of about 10 ppm to about 100 ppm, and most preferably is within the range of about 20 ppm to about 80 ppm. In this embodiment, the power level of the 800 nm laser is preferably less than about 30 Watts, or within the range of about 8 Watts to about 18 Watts.

In one embodiment of the present invention, the substance or product contained within the storage chamber is a fat containing liquid product, such as infant or baby formula, and the primary seal and the penetrable and thermally resealable portion or stopper, first container closure member, any other components of the container closure that is exposed to potential direct contact with the product stored within the chamber, and the body each are selected from materials (i) that are regulatory approved for use in connection with nutritional foods, and preferably are regulatory approved at least for indirect contact, and preferably for direct contact with nutritional foods, (ii) that do not leach an undesirable level of contaminants or non-regulatory approved leachables into the fat containing product, such mineral oil, and (iii) that do not undesirably alter the taste profile (including no undesirable aroma impact) of the fat containing liquid product to be stored in the container.

In the embodiment of the present invention wherein the product is a fat containing liquid nutrition product, such as an infant or baby formula, exemplary materials for the penetrable and thermally resealable portion or stopper are selected from the group including GLS 254-071, GLS LC254-071, GLS LC287-161, GLS LC287-162, C-Flex R70-001, C-Flex R70-005+ about 62.5 ppm Lumogen, C-Flex R70-005+ about 75 ppm Lumogen, Evoprene TS 2525 4213, Evoprene SG 948 4213, Evoprene G968-4179+ about 0.026% Carbon Black, Evoprene G968-4179+ about 62.5 ppm Lumogen and Cawiton 7193, modifications of any of the foregoing, or similar thermoplastic elastomers. In one such embodiment, the body is an injection molded multilayer of PP/EVOH. In another such embodiment, the body is blow molded, such as by extrusion blow molding, and is an HDPE/EVOH multi layer.

As may be recognized by those skilled in the pertinent art based on the teachings herein, numerous changes and modifications may be made to the above-described and other embodiments of the present invention without departing from its scope as defined in the appended claims. For example, the first and/or second chamber of the container can be filled with any desired substance such as, for example, a liquid product, an additive, a probiotic or combinations thereof, by any of numerous sterile filling methods that are currently known, or that later become known, and without forming and/or resealing a filling member aperture in one or both of the resealable portions, while maintaining the stored substances in the respective chambers separate (if desired) until mixing and dispensing occurs. Additionally, the nipple, seals and other components of the container closure may be made of any of numerous different materials that are currently known, or that later become known for performing their functions and/or depending on the container application(s), including the product to be stored within the container. For example, the nipple or teat may take any of numerous different configurations of nipples, and may be formed of any of numerous different nipple materials, that are currently known, or that later become known. As a further example, the penetrable and thermally resealable material may be blended with any of numerous different materials to obtain any of numerous different performance objectives. For example, any of the thermoplastic elastomers described above may be blended with, for example, small beads of glass or other insert beads or particles to enhance absorption of the laser radiation and/or to reduce or eliminate the formation of particles when needle penetrated. In addition, the body and container closure may take any of numerous different shapes and/or configurations, and may be adapted to receive and store within the storage chamber any of numerous different substances or products that are currently known or that later become known, including without limitation, any of numerous different food or beverage products, including low acid or fat containing liquid products, such as milk-based products, including without limitation milk, evaporated milk, infant formula, growing-up milks, condensed milk, cream, half-and-half, yoghurt, and ice cream (including dairy and non-diary, such as soy-based ice cream), other liquid nutrition products, liquid healthcare products, juice, syrup, coffee, condiments, such as ketchup, mustard, and mayonnaise, and soup, and pharmaceutical products. The term "liquid nutrition product" is used herein to mean enterally ingested liquids that are formulated primarily for meeting one or more specific nutritional requirements of, and that contribute to the energy requirements of, a person that ingests the liquid. Liquid nutrition products do not include, for example, foods and beverages that are administered other than enterally, such as parenteral or injectable liquids, pharmaceutical, dermatological, cosmetic, ophthalmic and veterinary products and preparations, vaccines, and dietary and nutritional supplements without sufficient calorific value to contribute to the energy requirements of a person that ingests the liquid. The term "food and beverage products" are used herein to mean food and beverages that are orally ingested by humans, but does not include liquid nutrition products, foods and beverages that are administered other than orally, such as by injection, pharmaceutical, dermatological, cosmetic, ophthalmic and veterinary products and preparations, vaccines, and dietary and nutritional supplements. In addition, although described with reference to liquid products herein, the containers and filling apparatus and methods equally may be employed with gaseous, powdered, and semi-solid products. Accordingly, this detailed description of preferred embodiments is to be taken in an illustrative, as opposed to a limiting sense.

What is claimed is:

1. A liquid nutrition product dispenser comprising:

a first body portion defining a first hermetically sealed chamber aseptically filled with a first liquid nutrition product hermetically sealed therein;

a second body portion defining a second hermetically sealed chamber;

a second chamber filling portion that is in fluid communication with the second hermetically sealed chamber and is configured to receive a filling member to aseptically fill the second hermetically sealed chamber with a second product therethrough, and is resealable to hermetically seal the second product within the second chamber;

wherein the second chamber is aseptically filled with a second product that is hermetically sealed therein, and the first and second chambers define (i) a storage state in which the first and second chambers are hermetically sealed relative to each other and the first and second products are prevented from intermixing, and (ii) a dispensing state in which the first and second chambers are in fluid communication with each other to allow intermixing and dispensing of the intermixed first and second products; and a dispensing device in fluid communication with at least one of the first and second chambers in the dispensing state for dispensing the intermixed first and second products therethrough.

2. A liquid nutrition product dispenser as defined in claim 1, further comprising a first chamber filling portion that is in fluid communication with the first hermetically sealed chamber and is configured to receive a filling member to aseptically fill the first hermetically sealed chamber with the first liquid nutrition product therethrough, and is resealable to hermetically seal the first liquid nutrition product within the first chamber.

3. A liquid nutrition product dispenser as defined in claim 1, wherein at least one of the first and second body portions is movable relative to the other from the storage state to the dispensing state.

4. A liquid nutrition product dispenser as defined in claim 1, wherein the first liquid nutrition product is a liquid nutrition product, and the second product is an additive.

5. A dispenser as defined in claim 4, wherein the liquid nutrition product is an infant formula, and the additive is a probiotic.

6. A liquid nutrition product dispenser as defined in claim 1, wherein the dispenser further comprises a sealing ring, wherein the sealing ring is adapted to engage with the first chamber so as to provide an enclosed mixing space defining the second chamber that is bounded by a wall of the first chamber, a wall of the dispensing device, and the sealing ring; wherein the mixing space contains a second product in the form of an additive for the liquid and is operable to open the chamber and permit the liquid to mix with the additive in the mixing space and be dispensed to the exterior through the dispensing device; and wherein the second chamber filling portion is located on a wall of the dispensing device and is penetrable by an injection member to form an aperture through which the additive is introduced into the mixing space.

7. A liquid nutrition product dispenser as defined in claim 6, wherein the first body portion defines a generally cylindrical sealed first chamber containing the first liquid.

8. A liquid nutrition product dispenser as defined in claim 1, wherein the dispensing device defines a teat.

9. A liquid nutrition product dispenser as defined in claim 1, wherein the dispensing device defines at least one of (i) a drinking spout, (ii) a drinking spout including a one-way check valve, wherein the check valve opens under negative pressure to allow the intermixed product to be dispensed therethrough, and (iii) a push-pull cap, wherein the push-pull cap defines an outlet aperture that is closed when the cap is in a retracted push position and the outlet aperture is open when the cap is in an extended pull position.

10. A liquid nutrition product dispenser as defined in claim 1, wherein the first liquid nutrition product is a base liquid product, and the second product is an additive to the first liquid nutrition product.

11. A liquid nutrition product dispenser as defined in claim 1, wherein the first liquid nutrition product is selected from the group consisting of a milk product, a soy product, a fat-containing product, a low acid product, and any combination of the foregoing, and the second product is selected from the group consisting of a probiotic supplement, vitamin supplement, mineral supplement, dietary supplement, flavoring, and a medicament.

12. A liquid nutrition product dispenser as defined in claim 2, wherein at least one of the first chamber filling portion and the second chamber filling portion is penetrable by an injection member for aseptically filling the respective chamber and is resealable for resealing the respective filling portion upon removing the injection member therefrom.

13. A liquid nutrition product dispenser as defined in claim 1, further comprising a first chamber filling portion in fluid communication with the first hermetically sealed chamber, wherein at least one of the first chamber filling portion and the second chamber filling portion is penetrable by a needle for aseptically filling the respective chamber through the needle and is resealable for resealing a resulting needle hole therein upon removing the needle therefrom.

14. A liquid nutrition product dispenser including a generally cylindrical sealed chamber containing a liquid nutrition product, a dispensing device, and a sealing ring, wherein the sealing ring is adapted to engage with the chamber so as to provide an enclosed mixing space bounded by an end wall of the chamber, a wall of the dispensing device and the sealing ring, wherein the mixing space contains an additive for the liquid and is operable to open the chamber and permit the liquid to mix with the additive in the mixing space and be dispensed to the exterior through the dispensing device, and wherein at least a portion of the wall of the dispensing device is penetrable by an injection member to form an aperture through which the additive may be introduced into the mixing space.

15. A liquid nutrition product dispenser as defined in claim 14, wherein the penetrable portion of the wall is resealable to reseal the aperture after removal of the injection member therefrom to hermetically seal the additive within the mixing space.

16. A liquid nutrition product dispenser as defined in claim 14, wherein a portion of the dispenser in fluid communication with the sealed chamber is penetrable by an injection member to form an aperture through which the liquid nutrition product may be introduced into the chamber, and the penetrable portion is resealable to seal the aperture after removal of the injection member therefrom to hermetically seal the liquid nutrition product within the chamber.

17. A liquid nutrition product dispenser as defined in claim 14, wherein the liquid nutrition product is selected from the group consisting of a milk product, a soy product, a fat-containing product, a low acid product, and any combination of the foregoing, and the additive is selected from the group consisting of a probiotic supplement, vitamin supplement, mineral supplement, dietary supplement, flavoring, and a medicament.

18. A liquid nutrition product dispenser comprising:

first means for forming a first hermetically sealed chamber aseptically filled with a first liquid nutrition product hermetically sealed therein;

second means for forming a second hermetically sealed chamber aseptically filled with a second product hermetically sealed therein;

third means in fluid communication with the second hermetically sealed chamber for receiving a filling member, aseptically filling the second hermetically sealed chamber with a second product therethrough, and resealing after aseptically filling therethrough for hermetically sealing the second product within the second chamber;

fourth means for moving at least one of the first means and the second means relative to the other between (i) a storage state in which the first and second chambers are hermetically sealed relative to each other for preventing intermixing of the first and second products, and (ii) a dispensing state in which the first and second chambers are in fluid communication with each other for intermixing and dispensing of the intermixed first and second products; and fifth means in fluid communication with at least one of the first and second chambers in the dispensing state for dispensing the intermixed first and second products therethrough.

19. A liquid nutrition product dispenser as defined in claim 18, wherein the first means is a first body portion defining the first hermetically sealed chamber; the second means is a second body portion for defining the second hermetically sealed chamber; the third means is a penetrable and resealable portion of the of the second body portion; the fourth means is defined by one of the first and second body portions being slidably mounted on the other and sealed relative thereto; and the fifth means is a dispensing device.

20. A method comprising the following steps:

filling a device including a first body portion defining a first chamber; a second body portion defining a second filling portion and a second chamber in fluid communication with the second portion; wherein the first and second chambers define a storage state in which the first and second chambers are hermetically sealed relative to each other, and a dispensing state in which the first and second chambers are in fluid communication with each other to allow intermixing and dispensing of the intermixed first and second products; and a dispensing device in fluid communication with at least one of the first and second chambers in the dispensing state for dispensing the intermixed first and second products therethrough; the filling step comprising:

hermetically sealing within the first chamber a base liquid nutrition product;

introducing a filling member into the second filling portion and aseptically filling the second chamber with an additive therethrough; and removing the filling member from the second filling portion and resealing the second filling portion to hermetically seal the additive therein.

21. A method as defined in claim 20, further comprising moving at least one of the first and second chambers from (i) the storage state in which the base liquid nutrition product and additive are hermetically sealed relative to each other and are prevented from intermixing, to (ii) the dispensing state in which the first and second chambers are in fluid communication with each other, and further comprising intermixing and dispensing of the intermixed base liquid nutrition product and additive.

22. A method as defined in claim 21, further comprising the steps of introducing a filling member into a first filling portion of the first body portion and aseptically filling the first chamber with the base liquid nutrition product therethrough; and removing the filling member from the first filling portion and resealing the first filling portion and hermetically sealing the base liquid nutrition product therein.

23. A method as defined in claim 20, wherein the base liquid nutrition product is selected from the group consisting of a milk product, a soy product, a fat-containing product, a low acid product, and any combination of the foregoing, and the additive is selected from the group consisting of a probiotic supplement, vitamin supplement, mineral supplement, dietary supplement, flavoring, and a medicament.

24. A liquid nutrition product dispenser as defined in claim 12, wherein the at least one of the first chamber filling portion and the second chamber filling portion is thermally resealable.

25. A liquid nutrition product dispenser as defined in claim 13, wherein the at least one of the first chamber filling portion and the second chamber filling portion is laser resealable.

26. A liquid nutrition product dispenser as defined in claim 15, wherein the penetrable portion of the wall is thermally resealable.

27. A liquid nutrition product dispenser as defined in claim 16, wherein the penetrable portion is thermally resealable.

28. A liquid nutrition product dispenser as defined in claim 19, wherein the third means is a penetrable and thermally resealable portion of the of the second body portion.

29. A liquid nutrition product dispenser as defined in claim 1, wherein at least one of the first and second body portions is rotatable relative to the other from the storage state to the dispensing state.

* * * * *